US007461758B2

(12) United States Patent
Serfaty

(10) Patent No.: US 7,461,758 B2
(45) Date of Patent: Dec. 9, 2008

(54) DISPENSER FOR SEPARATELY DISPENSING WET AND DRY PAPER IN THE SHAPE OF A CONVENTIONAL ROLL OF TOILET PAPER

(76) Inventor: Armand Serfaty, 130 W. 57th St., New York, NY (US) 10019

( * ) Notice: Subject to any disclaimer, the term of this patent is extended or adjusted under 35 U.S.C. 154(b) by 114 days.

(21) Appl. No.: 11/507,074

(22) Filed: Aug. 18, 2006

(65) Prior Publication Data

US 2007/0125901 A1 Jun. 7, 2007

Related U.S. Application Data

(63) Continuation-in-part of application No. 11/057,981, filed on Feb. 14, 2005, now Pat. No. 7,311,221.

(60) Provisional application No. 60/544,378, filed on Feb. 13, 2004.

(51) Int. Cl.
*B65H 1/28* (2006.01)

(52) U.S. Cl. ..... 221/35; 221/283

(58) Field of Classification Search ..... 242/588, 242/588.3, 598.5, 598.6, 596.8; 221/34, 221/35, 45, 63, 199, 283
See application file for complete search history.

(56) References Cited

U.S. PATENT DOCUMENTS 4,108,513 A 8/1978 Lander
4,984,530 A 1/1991 Dutton
5,660,313 A 8/1997 Newbold
5,697,577 A 12/1997 Ogden
5,988,561 A 11/1999 Mele
6,536,707 B2 * 3/2003 Adelakun ..... 242/598.6
6,537,631 B1 3/2003 Rivera
6,659,391 B1 * 12/2003 Faulks et al. ..... 242/598.6
7,311,221 B2 * 12/2007 Serfaty ..... 221/35
2002/0190154 A1 * 12/2002 Newman et al. ..... 242/598.6

* cited by examiner

*Primary Examiner*—William A Rivera
(74) *Attorney, Agent, or Firm*—Ladas and Parry LLP

(57) ABSTRACT

A dispenser for wet and dry paper includes a housing supporting a first canister for wet paper and a second canister for dry paper, the first and second canisters being separate and provided with their respective papers in isolation from one another for being removed in use from the respective canister through a dispensing opening therein. The canisters are detachably and interchangeably connected to the housing to define a generally cylindrical shape simulating that of a conventional roll of toilet paper. The housing receives a telescoping rod, such as a conventional toilet paper holder, which is supported in conventional brackets. The back of the housing is secured to a support, such as a wall.

30 Claims, 28 Drawing Sheets

DISPENSER FOR SEPARATELY DISPENSING WET AND DRY PAPER IN THE SHAPE OF A CONVENTIONAL ROLL OF TOILET PAPER

CROSS-RELATED APPLICATIONS

This application is a continuation-in-part of Ser. No. 11/057,981 filed Feb. 14, 2005 now U.S. Pat. No. 7,311,221 and claims the priority thereof and of provisional application 60/544,378 filed Feb. 13, 2004.

FIELD OF THE INVENTION

The invention relates to a dispenser for separately dispensing wet and dry paper.

In particular, the invention relates to such dispenser in which separate canisters are provided for the wet and dry paper to keep the wet and dry paper separate from one another.

The invention also relates to a method of assembling such a dispenser.

BACKGROUND AND PRIOR ART

The following patents are related to dispensing paper from dispensers.

| | |
|---|---|
| Lander | 4,108,513 |
| Dutton | 4,984,530 |
| Newbold | 5,660,313 |
| Ogden | 5,697,577 |
| Mele | 5,988,561 |
| Rivera | 6,537,631 |
| Faulks | 6,659,391 |

Newbold shows premoistened toilet paper in a dispenser adapted to be mounted on a conventional toilet paper hold.

Rivera, Ogden, Faulks and Mele are cumulative and show similar arrangements. Lander shows dispensing toilet paper from two separate rolls. Dutton shows two rolls of paper separately delivered from a common dispenser.

SUMMARY OF INVENTION

An object of the invention is to provide a dispenser for wet and dry paper in which separate canisters are utilized for the wet and dry paper and when assembled the canisters form a configuration which simulates a conventional roll of toilet paper.

Another object of the invention is to provide a dispenser in which the canisters are easily replaced when they become empty.

A further object of the invention is to provide such a dispenser which can replace the conventional roll of toilet paper and use the same brackets or lugs to mount the dispenser.

Still a further object of the invention is to make a housing for the canisters as a rigid one-piece body, preferably made of molded plastic material.

Yet another object of the invention is to securely fasten the housing to a support, such as a wall.

In order to achieve these and further objects, the invention provides a dispenser for separate dispensing of wet and dry paper which comprises: a housing, a first canister for wet paper, and a second canister for dry paper. The first and second canisters are separate and provided with their respective papers in isolation from one another for being removed in use from the respective canister through a dispensing opening therein. The canisters are connected to the housing so that the wet and dry papers can be removed from the respective canisters. The housing is supported from brackets of a toilet paper holder and is secured to a back wall.

In accordance with a feature of the invention, the paper is encapsulated in the wet paper container to prevent evaporation.

According to another feature, the first and second canisters have separate dispensing openings for the wet paper and the dry paper, respectively.

In further accordance with the invention, the housing includes a shelf including means for securing the shelf in bores in the brackets which normally can support a holder for a toilet paper roll. First and second canisters are provided for wet paper and dry paper. The canisters have a respective opening for removing the paper therefrom. The canisters are mounted on opposite sides of the shelf. The canisters have a respective surfaces of part-cylindrical shape cooperatingly forming a cylindrical outline simulating a roll of toilet paper.

According to another feature of the invention, each canister is replaceably and interchangeably mounted on the shelf.

In further accordance with the invention, there is provided a method by which separate dispensing of wet paper and dry paper can be obtained from a common dispenser, the method being achieved by the steps of providing a first canister containing wet paper, the canister having an opening from which the wet paper can be removed; providing a second canister containing dry paper, the second canister having an opening from which the dry paper can be removed; supporting a housing by a rod engaged in holes in brackets normally used for supporting a roll of toilet paper; securing said housing to a wall to fix the housing in place between said brackets; and detachably connecting the first and second canisters to said housing with the openings thereof facing forwardly to enable separate dispensing of the wet and dry papers.

According to a further feature of the invention, the first canister for wet paper forms a hermetic enclosure for the wet paper.

According to a further feature of the invention, the canisters are formed such that they can be interchangeably mounted at the top or bottom of the housing.

DETAILED DESCRIPTION

Figure 1:
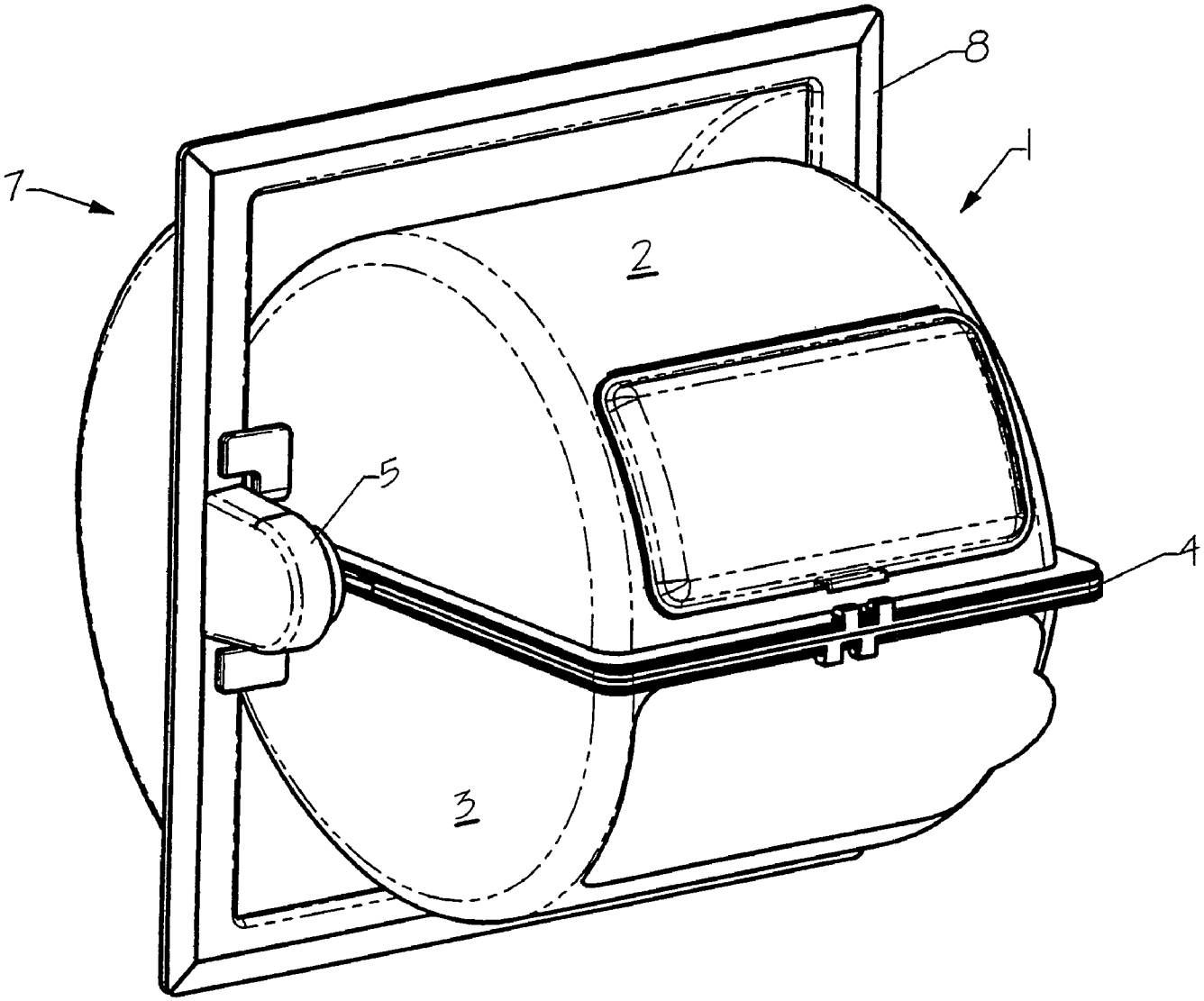
FIG. 1 is a front perspective view of a first embodiment of a dispenser for wet and dry paper according to the invention.

In FIG. 1, there is seen a first embodiment of a dispenser 1 of the invention which comprises a canister 2 containing moistened paper (hereafter referred to as wet paper) and a canister 3 containing dry paper such as toilet paper. The wet paper and dry paper are supported in their respective canisters for being dispensed therefrom through respective openings as will be seen later.

The canisters 2, 3 are each of semi-cylindrical shape and are connected together to form the dispenser 1 as a casing or housing of cylindrical shape simulating a conventional roll of toilet paper. This will enable the housing to be installed in conventional support structures normally used to support a roll of toilet paper as will be seen later.

Figure 2:
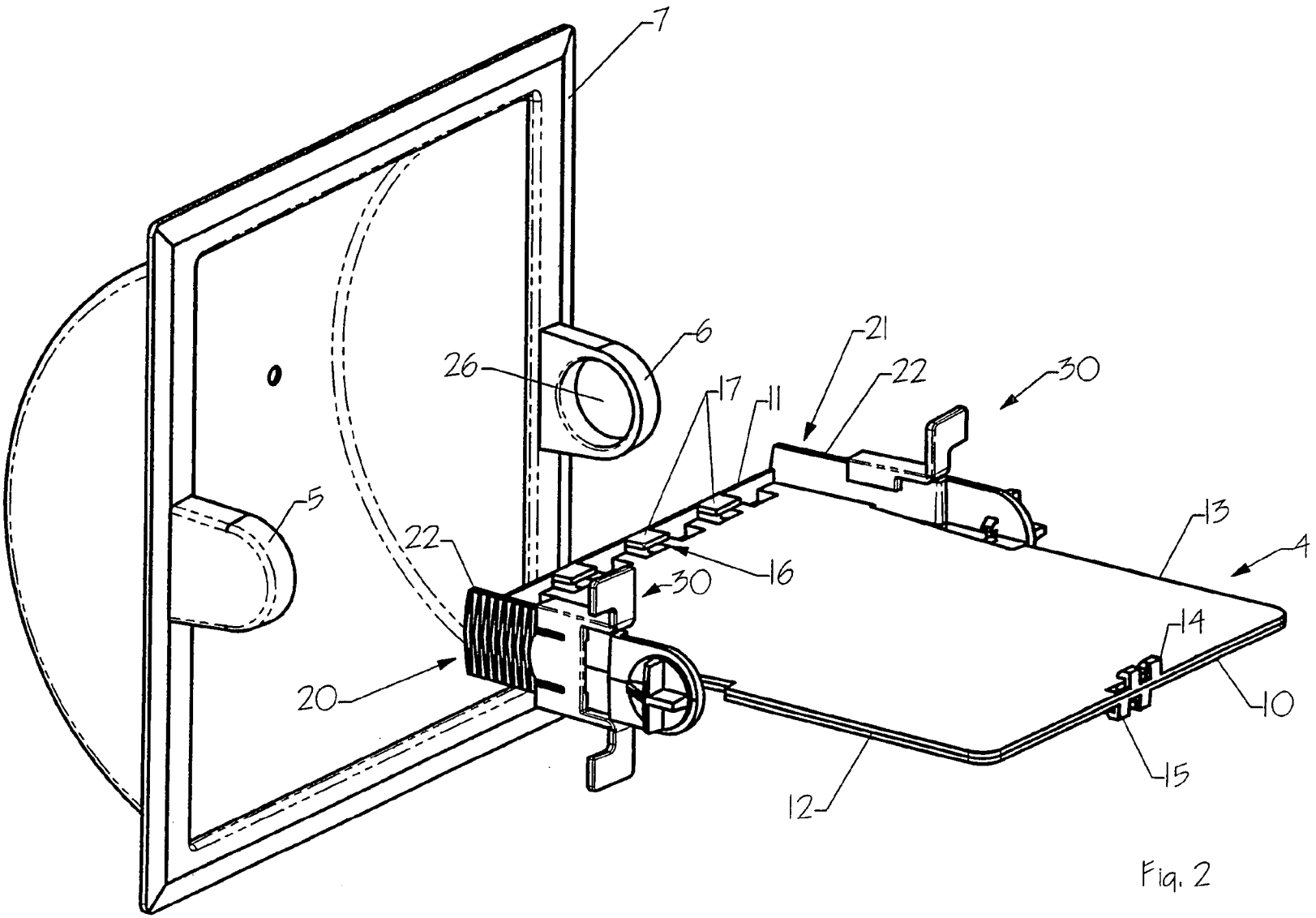
FIG. 2 is an exploded view showing a shelf of the dispenser separated from a holder of the dispenser.
Figure 3:
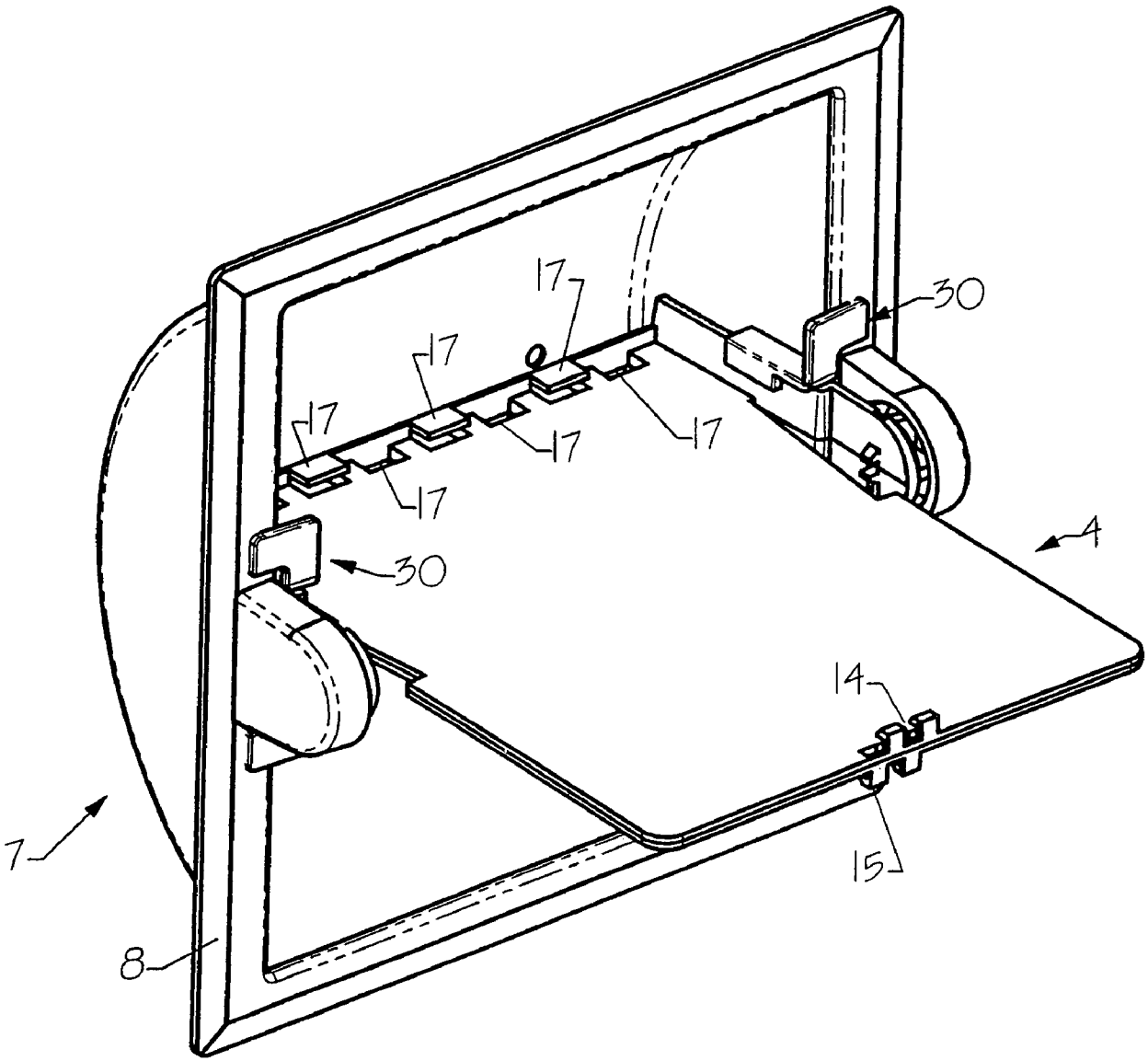
FIG. 3 shows the shelf supported in the holder.

The canister 2 and 3 are mounted on a shelf 4 which serves to connect the dispenser 1 to conventional brackets or lugs 5, 6 (FIG. 2) which normally support a conventional rod for a roll of toilet paper.

The lugs or brackets are secured to a support that can take many forms. For illustrative purposes, the invention will be described with reference to a conventional concave holder 7 which is secured in a hole in a wall and which includes a frame 8 adapted to abut against the edge of the hole in the wall. The wall for the holder 7 can be the wall of a cabinet or the wall in a bathroom or other location where the dispenser 1 is installed. The lugs 5, 6 can be secured to the supporting wall in other ways as well known in the art without the need for detailed explanation. However, in all cases, lugs 5, 6 project from the supporting wall for normally supporting the rod for holding a roll of toilet paper.

The canister 2 for wet paper is intended to supply individual or continuous sheets of wet paper, such as "wet wipes" or the like while the canister 3 is intended to supply dry paper in the manner of conventional toilet paper or individual sheets. The moistened or wet paper can be moistened by a liquid, generally water based, which can contain medicaments, cleansing agents, scenting agents or the like depending on the ultimate use.

Referring to FIGS. 2-5, the shelf 4 is seen as being formed as a flat member having a front edge 10, a rear edge 11, and side edges 12 and 13. At the front edge 10, there are formed latch members 14, 15 which are offset from one another to latch the canisters 2, 3 as will be explained later. At the rear edge 11, the shelf is formed with a rear wall 18 from which hooks 17 extend respectively at the top and bottom surfaces of shelf 4 to overlie the shelf. The hooks at the top surface of the shelf are visible at 17 and the hooks at the bottom surface of the shelf are the same and are interspaced with hooks 17 at the top surface of the shelf. The shelf 4 is formed with castellations 16 at the rear edge, and rear wall 18 closes the back of the shelf 4.

Figure 9:
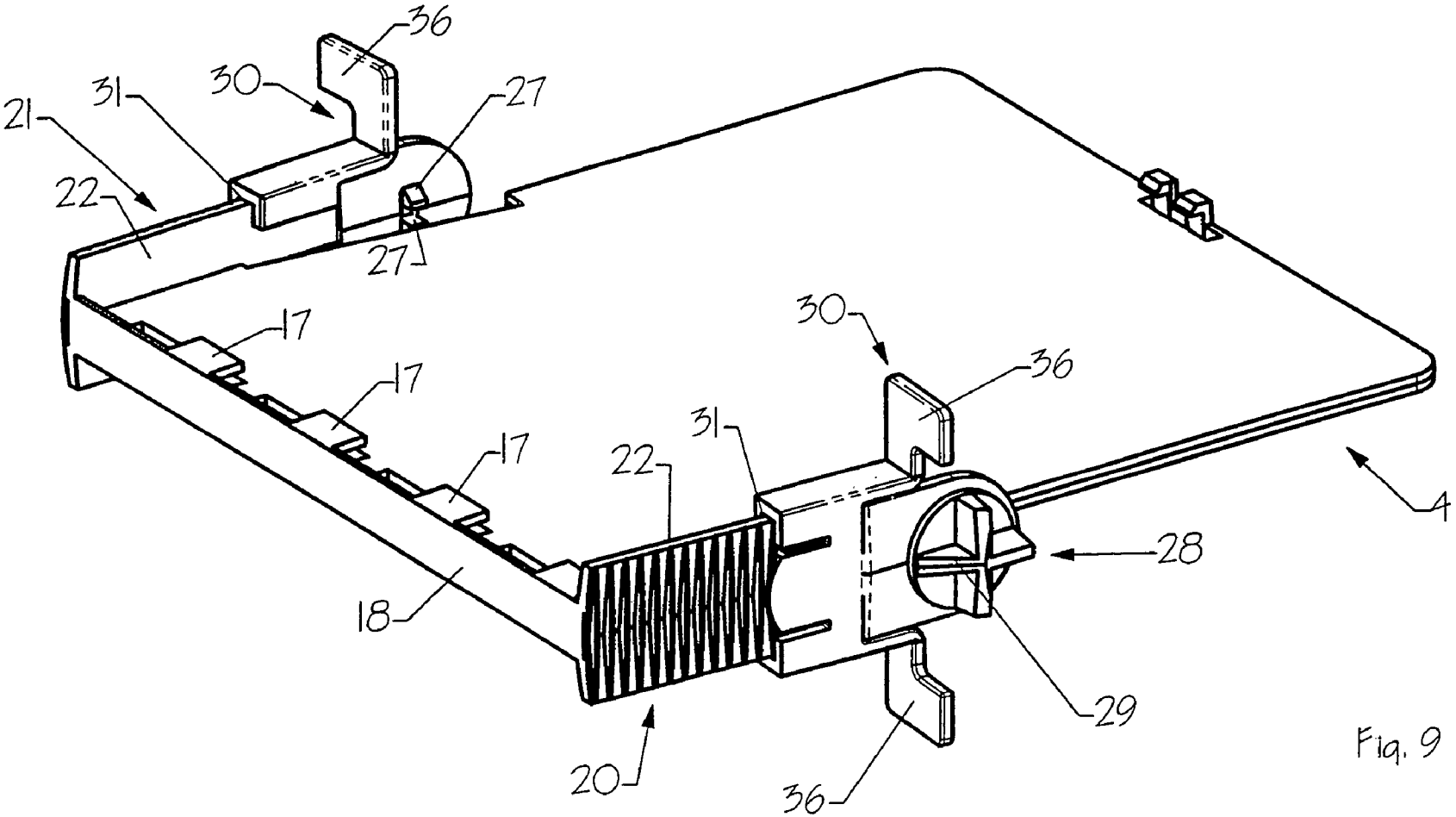
FIG. 9 is a rear view showing the tab locks installed on the shelf.

The shelf 4 is formed with engagement members 20, 21 at the side edges 12, 13 and the engagement members 20, 21 are integral with the rear wall 18 (as best seen in FIG. 9). The engagement members 20, 21 serve as a means to secure the shelf 4 to lugs 5, 6.

Figure 4:
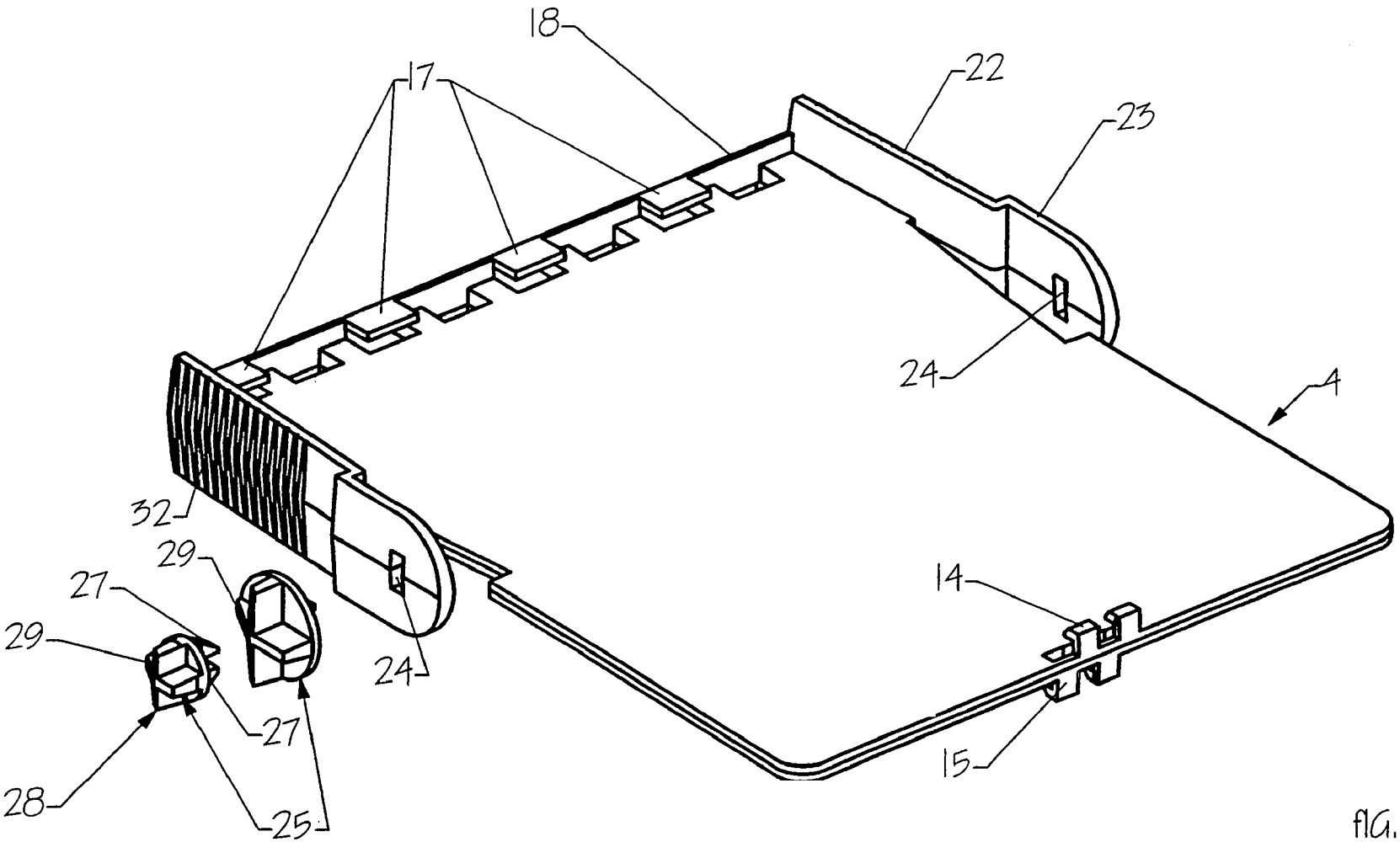
FIG. 4 shows the shelf in readiness to receive a support stud.
Figure 5:
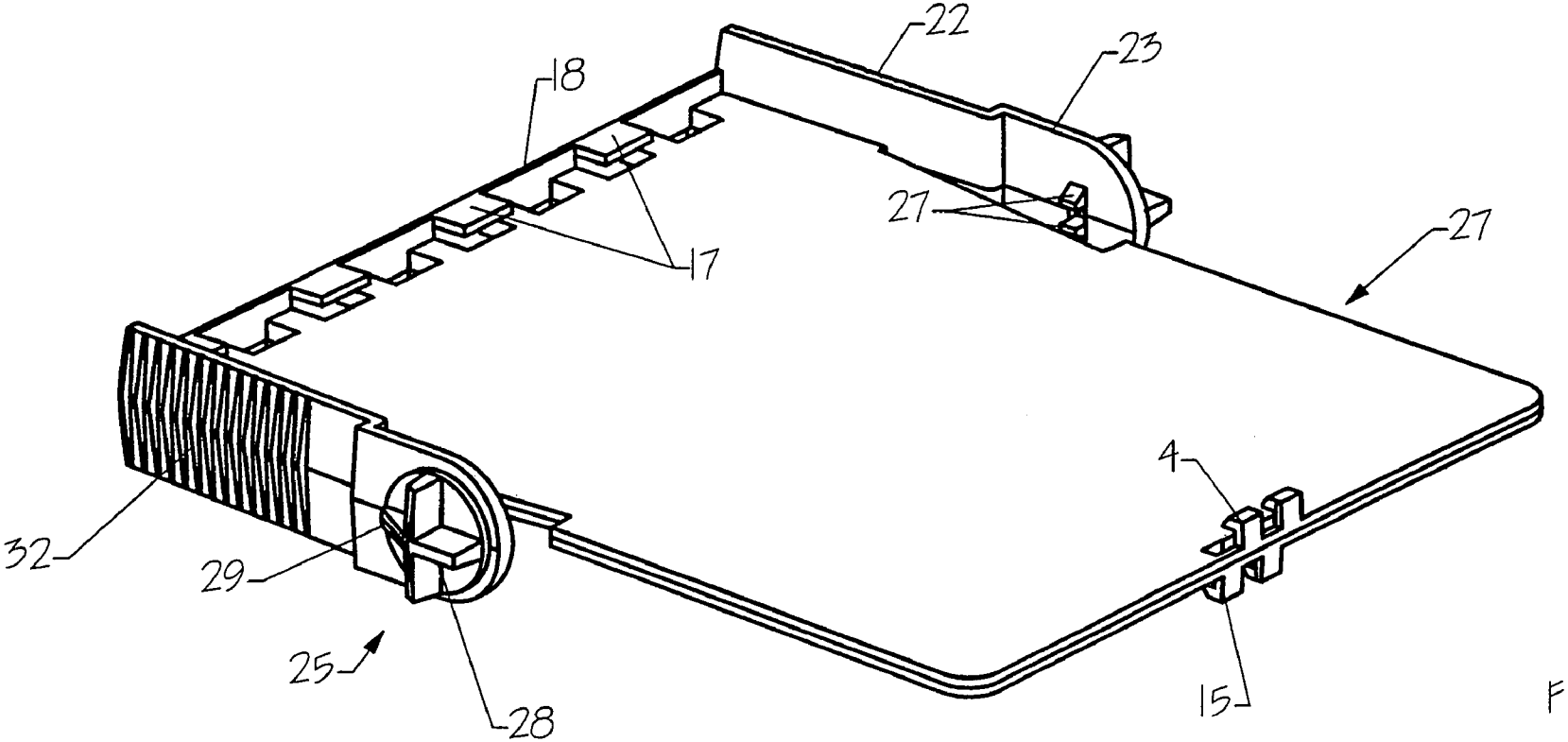
FIG. 5 shows the shelf of FIG. 4 with studs installed thereon.
Figure 6:
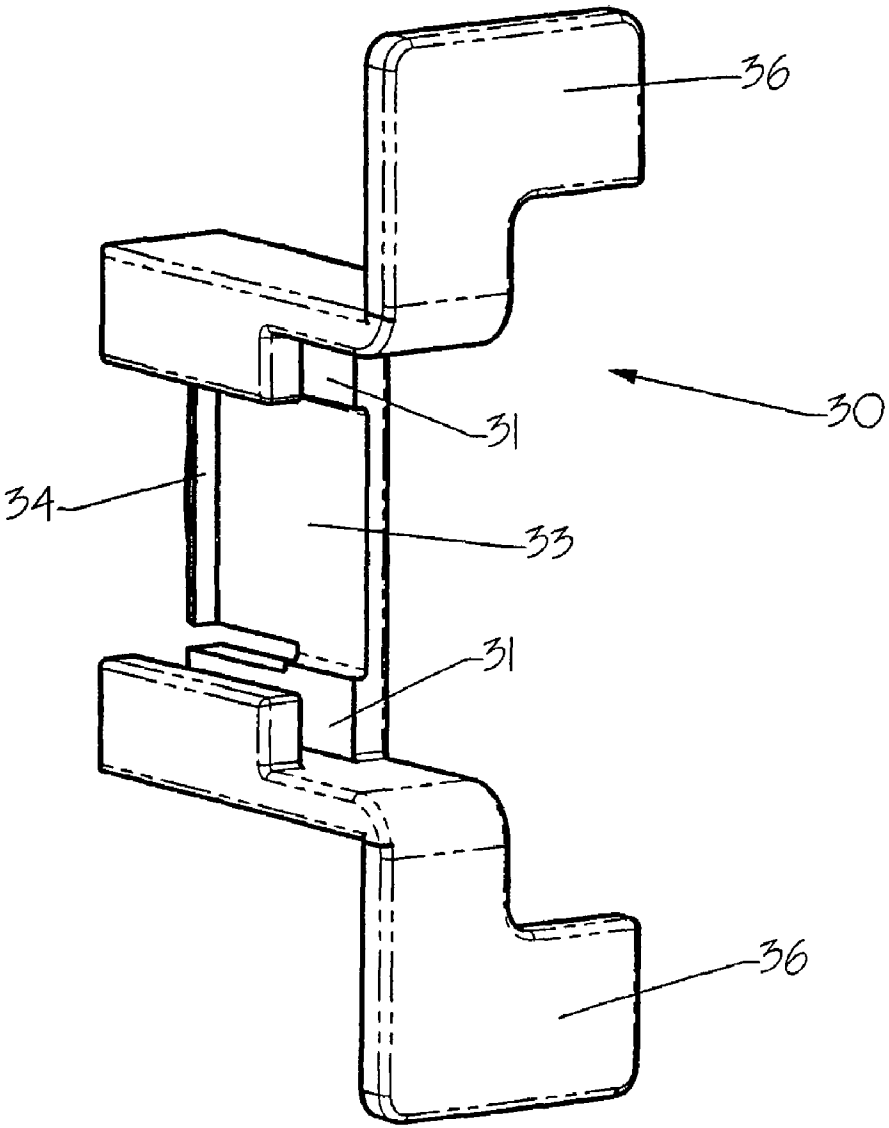
FIG. 6 is a perspective view of a tab lock for the dispenser.

As clear from FIG. 4, each engagement member 20, 21 includes a portion 22 integral with the rear wall 18 of the shelf and a wing 23 which extends from portion 22 and is laterally offset outwardly therefrom to provide some degree of elasticity of the wing to enable lateral elastic displaceability. The wing 23 is provided with a slot 24.

In order to enable the shelf 4 to be engaged in lugs 5, 6, a plurality of different size studs 25 are provided which are intended to be fitted in blind bores or holes 26 in lugs 5, 6.

After selecting the particular size of the stud 25 which fits in the blind bore 26, a pair of resilient locking claws 27 provided on the back side of the studs are snapped into slot 24 to lock against the upper and lower edges of slot 24. The stud 25 has an outer projecting portion 28 of T-shape with a rearwardly projecting cam 29 of triangular shape.

Figure 7:
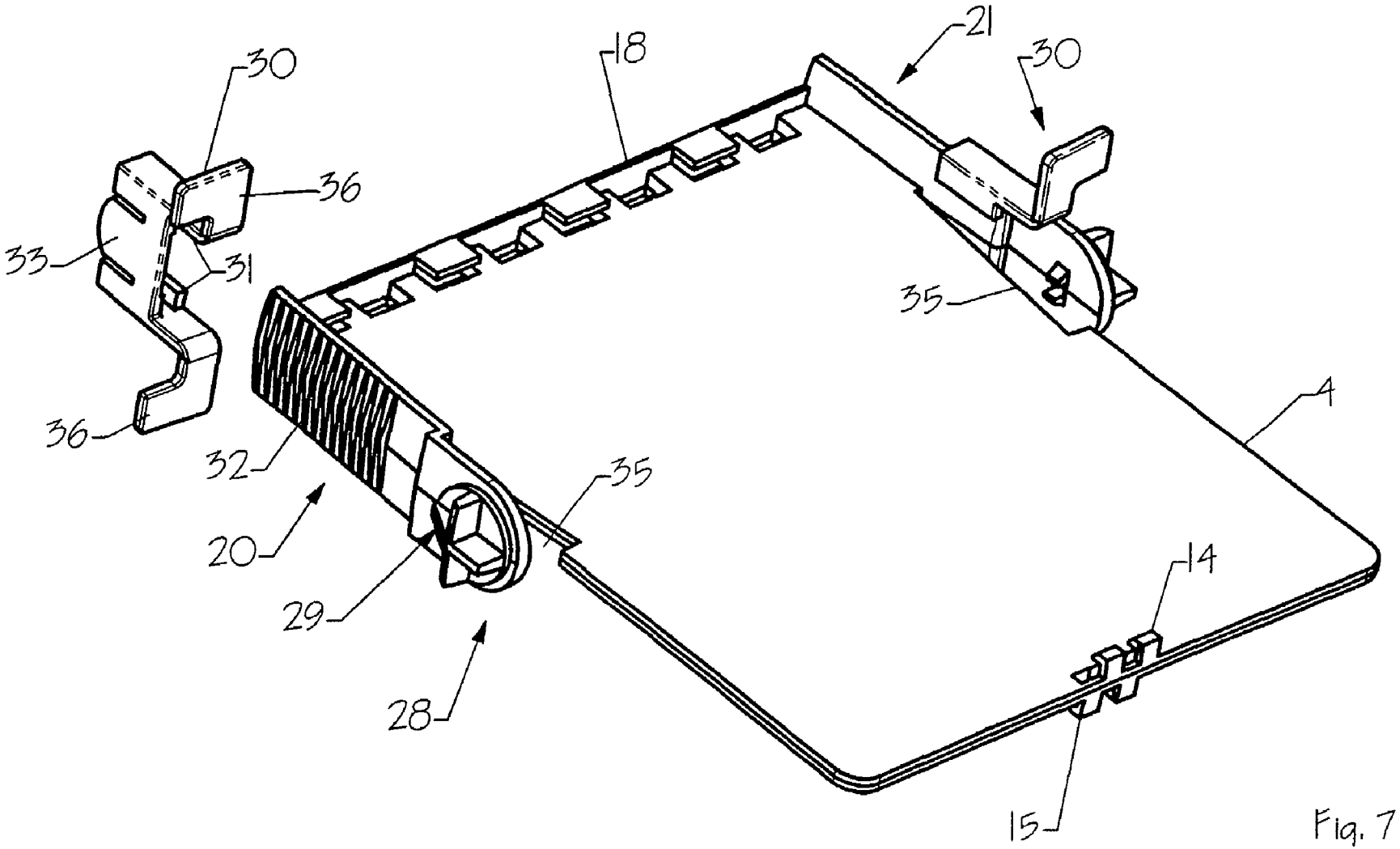
FIG. 7 shows the shelf with the tab lock at the left edge in preparation for installation on the shelf while the tab lock at the right edge is installed on the shelf.
Figure 8:
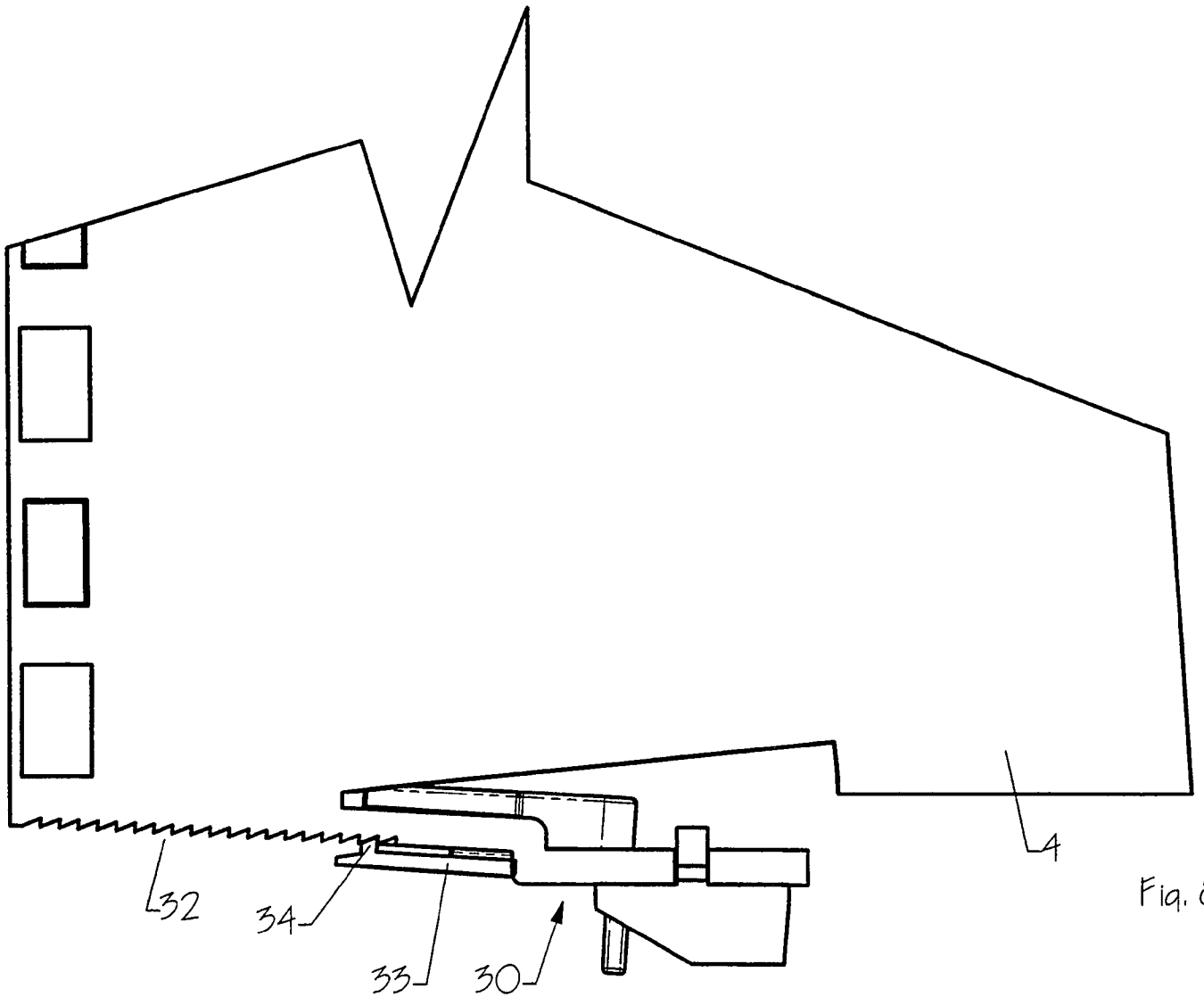
FIG. 8 is an enlarged top plan view of a portion of the left side of the shelf showing the engagement of the tab lock on the shelf.

A pair of tab locks 30 are provided at the opposite sides of the shelf 4 and are mounted on the portions 22 of the engagement members 20, 21. In FIG. 7, the tab lock 30 at the left side of the shelf is shown in readiness for being mounted on engagement member 20 while the tab lock 30 at the right edge 9 of shelf 4 is mounted on engagement member 21.

Each tab lock 30 is provided with grooves 31 at its top and bottom to slidably ride on the top and bottom edges of portion 22 of the respective engagement members 20, 21. The outer face of portion 22 is formed with a series of ratchets 32 and the tab locks 30 have flexible tongues 33 with an inwardly facing locking tooth 34 at its end for lockingly engaging the ratchet.

Figure 10:
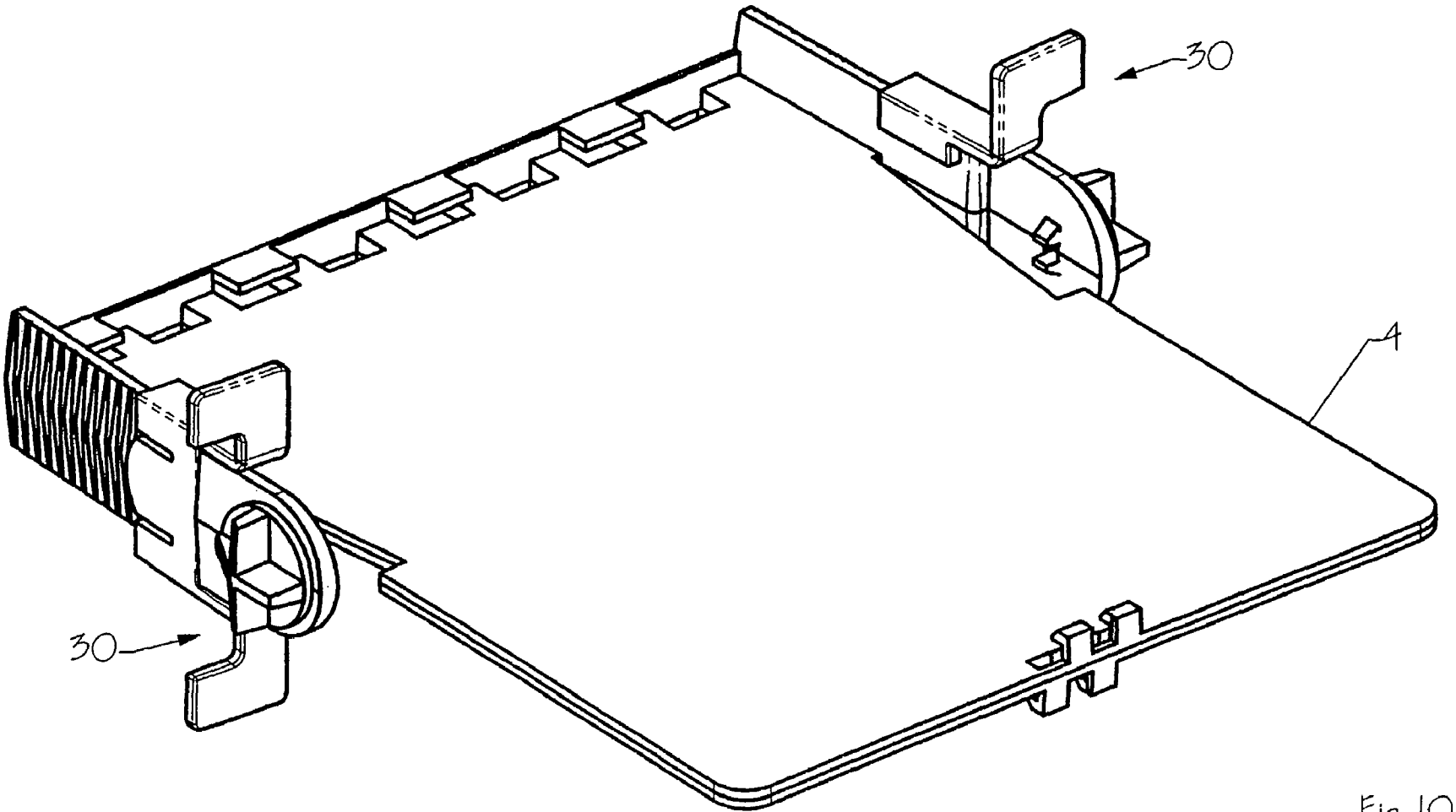
FIG. 10 shows the shelf with the tab locks installed and ready to be inserted into the holder.
Figure 11:
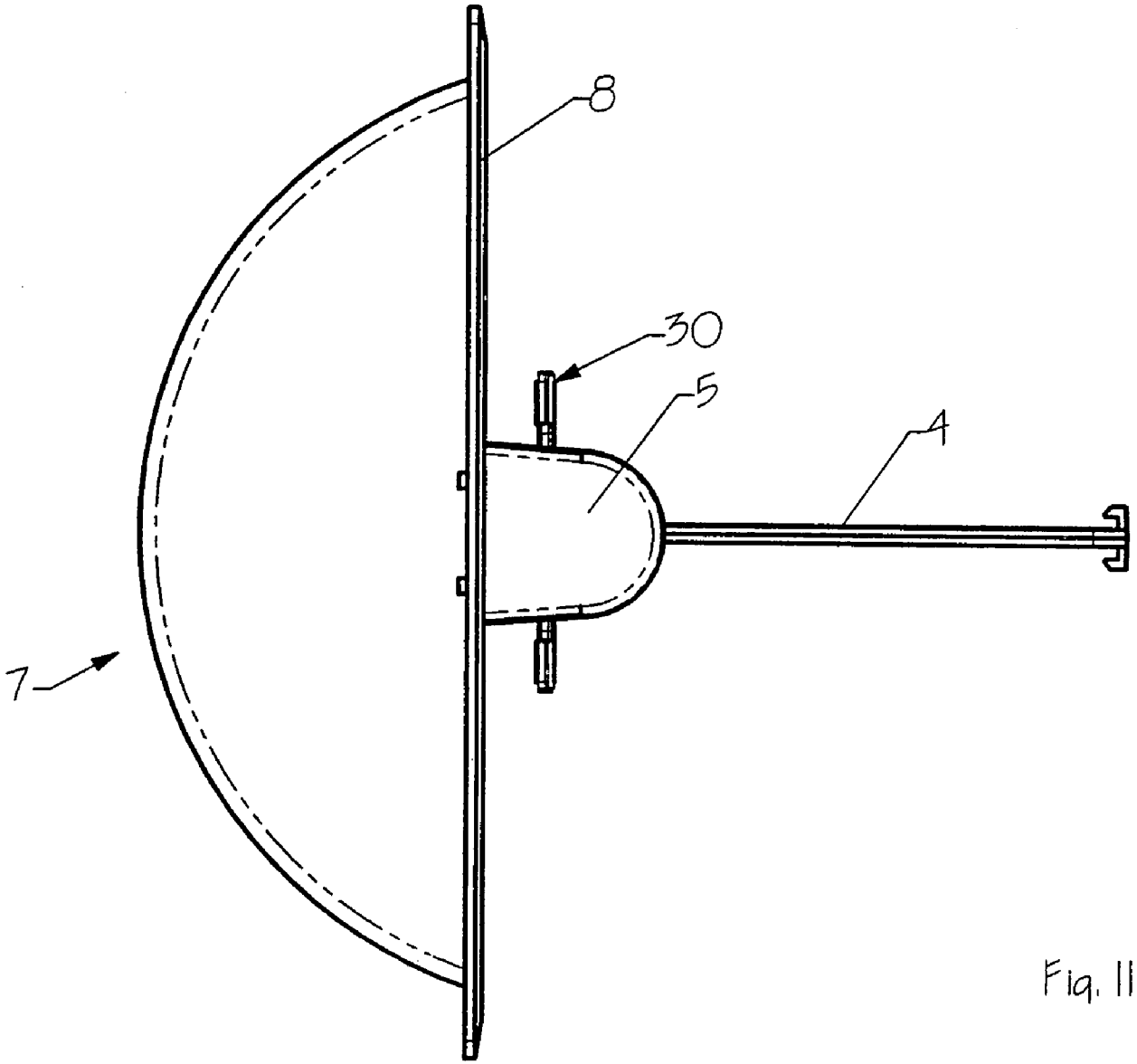
FIG. 11 is a side view showing the shelf supported in the holder with the tab locks retracted.
Figure 12:
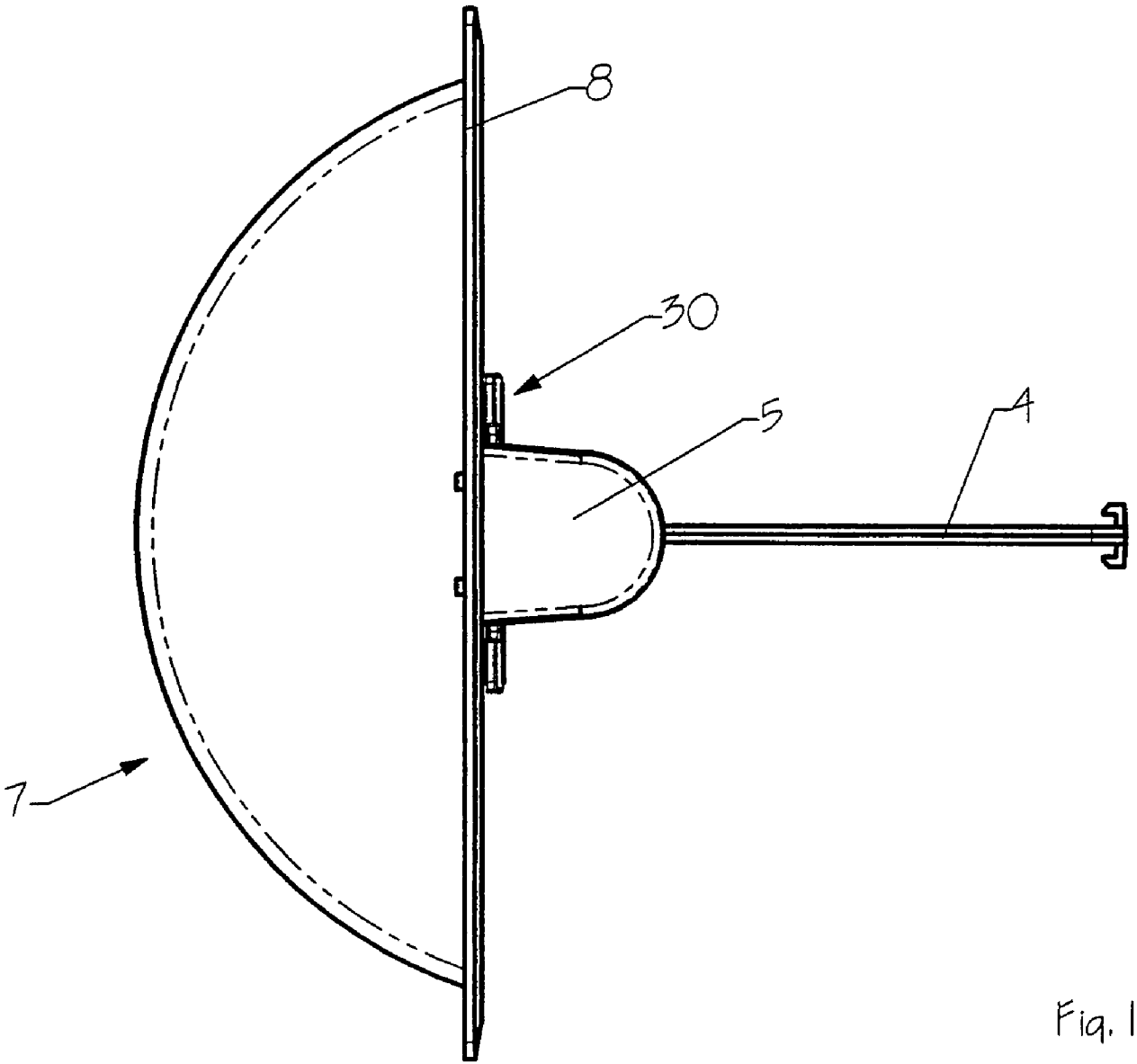
FIG. 12 shows the tab locks after being pushed against the frame of the holder.
Figure 13:
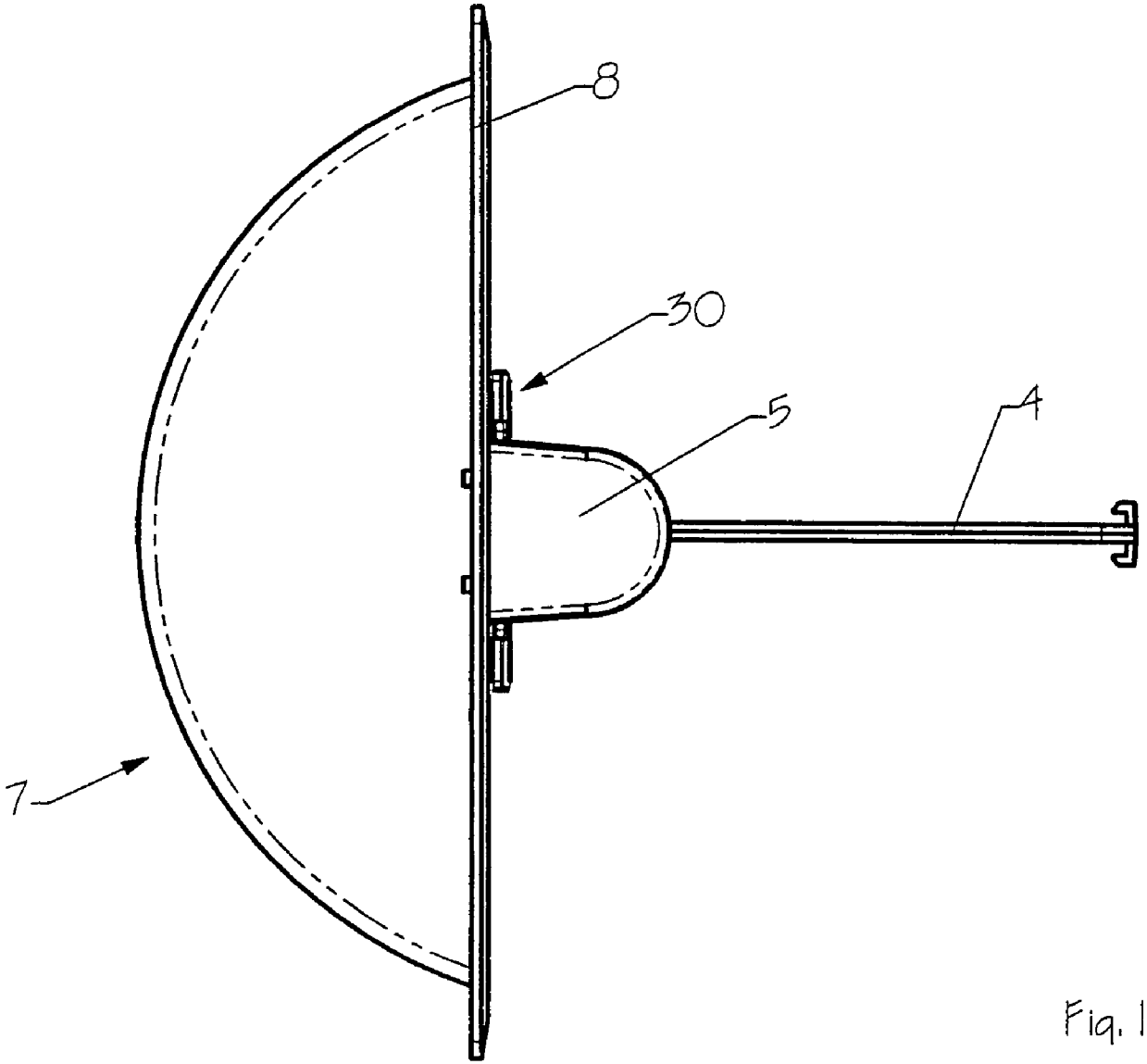
FIG. 13 is a perspective view of FIG. 12.

After the tab locks 30 have been installed on the portions 22 of the engagement members 20, 21 (as shown in FIGS. 9 and 10), the shelf is ready to be installed in the lugs 5, 6. To achieve this, the rear edge 11 of the shelf is inserted into the hollow of holder 7 causing the cams 29 to contact the lugs 5, 6 and force the wings 23 inwardly. The shelf is provided with slots 35 facing the wings 23 to accommodate the inward displacement of the wings. When the outer projecting portions 28 of the studs 25 reach the blind bores 26 in the lugs 5, 6, the projecting portions 28 snap into the blind bores and secure the shelf in the lugs. The tab locks 30 are then slidably moved rearwardly until outwardly facing flanges 36 of the tab locks bear against the frame 8 of the holder 7 as seen in FIGS.

12 and 13. The locking teeth 34 on tongues 33 are now engaged with the ratchets 32 and the shelf is tightly secured to the lugs.

The canisters 1, 2 are now ready to be secured to the shelf 4 to complete the assembly as will be explained hereafter.

Figure 14:
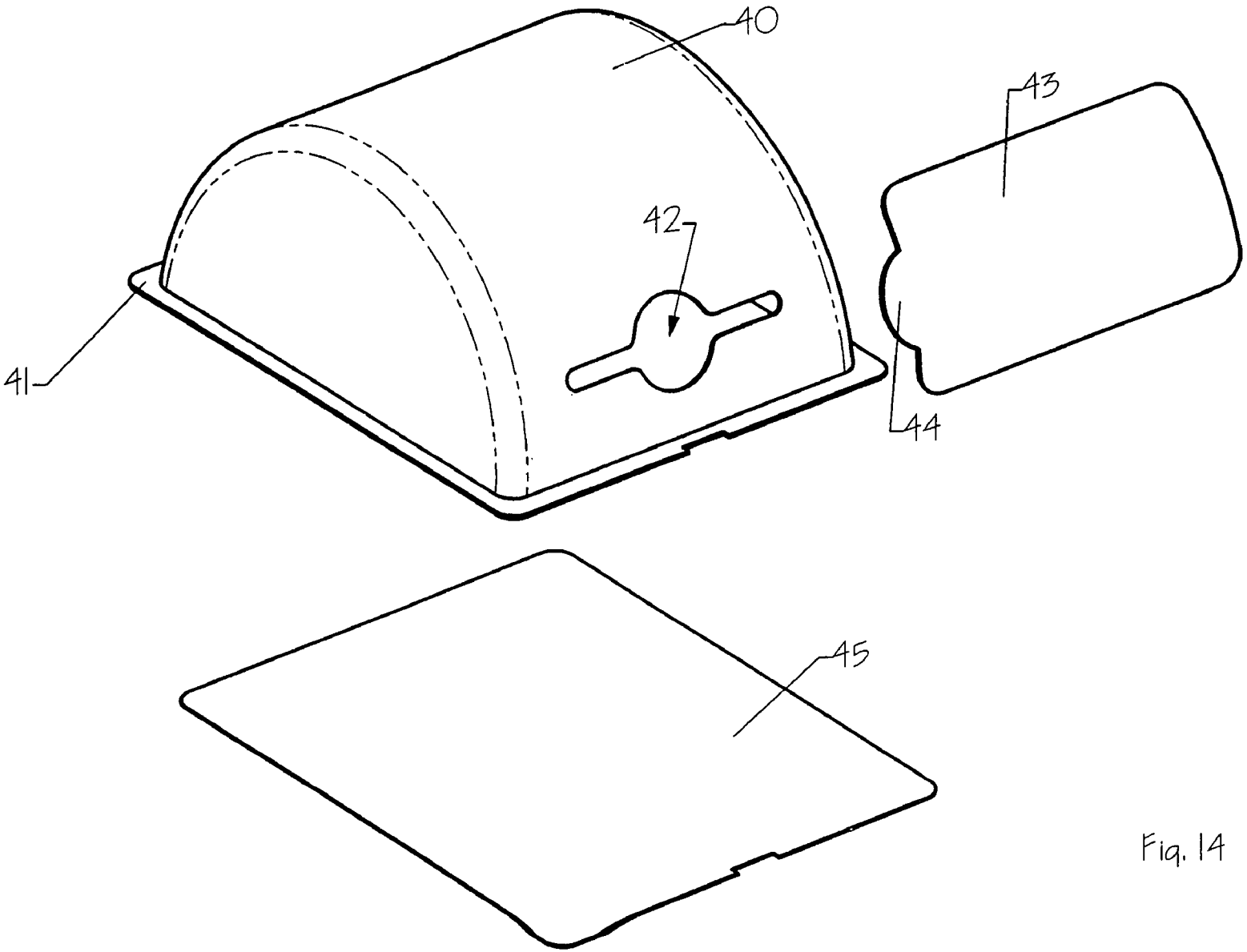
FIG. 14 is an exploded view of a canister for dry paper.
Figure 15:
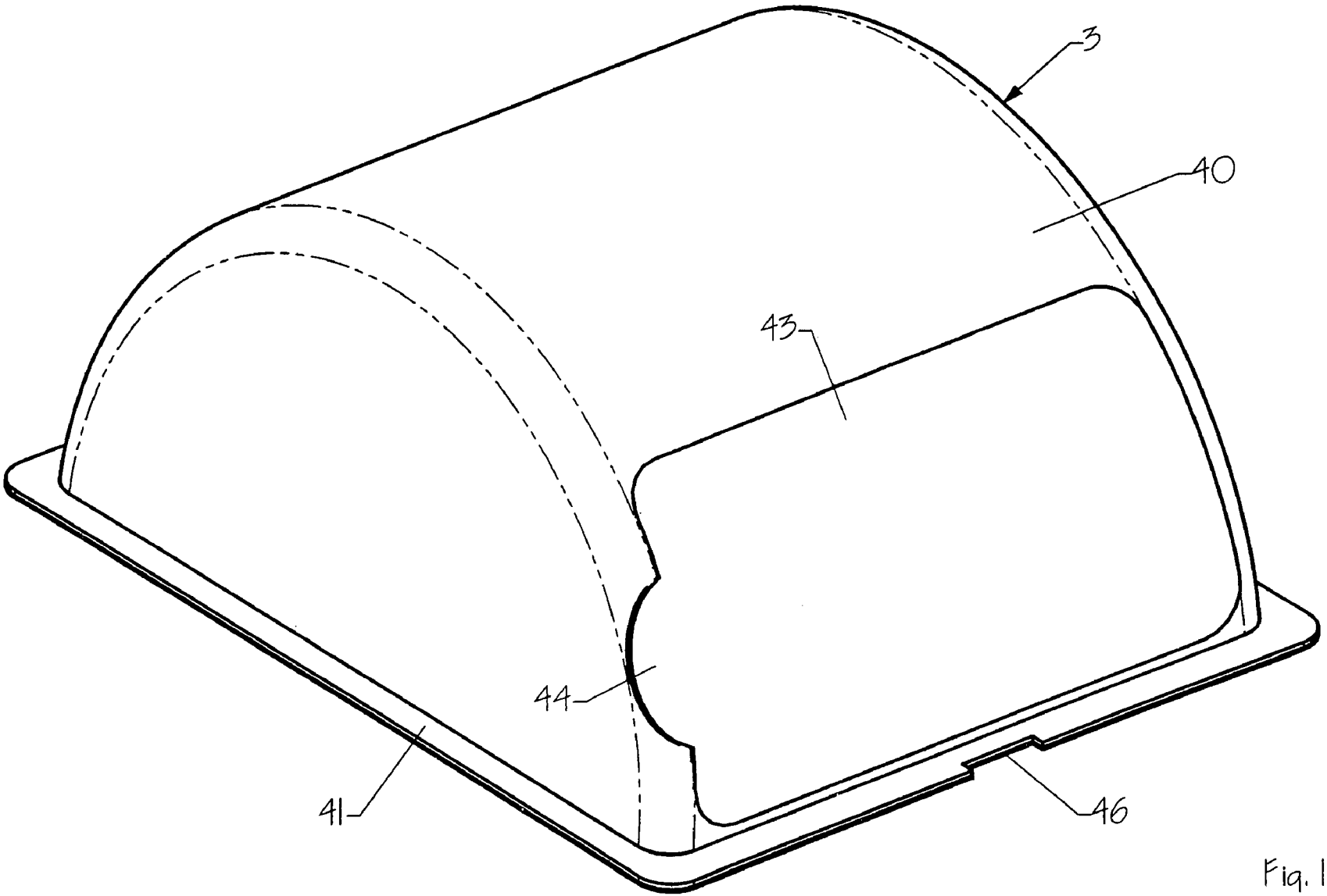
FIG. 15 shows the assembled dry paper canister.

FIG. 14 is an exploded view of the dry paper canister 3 which includes a semi-cylindrical cover 40 of dome shape and a flat base 41 on which the cover 40 is formed. The canister 3 is preferably made of thin plastic material which can be injection molded. Dry paper (not shown) is interleaved or otherwise connected and placed in the canister so that the paper can be extracted either as individual sheets or as a continuous sheet through a dispensing opening 42. The dispensing opening 42 is closed by a removable peel-off cover 43 of sheet form which has a tab 44 to enable removal of the cover 43 when the canister is installed and ready for first use.

The base 41 is slightly greater in extent than the bottom edge of the cover 40 to extend therearound. The base 41 is affixed on a deck 45 having the same size as the base 41. The base and deck can be integrally formed with one another and made as a single part integrated with cover 40. At the front edge of the canister 3 there is formed a slot 46 adapted to engage latch member 15.

Figure 18:
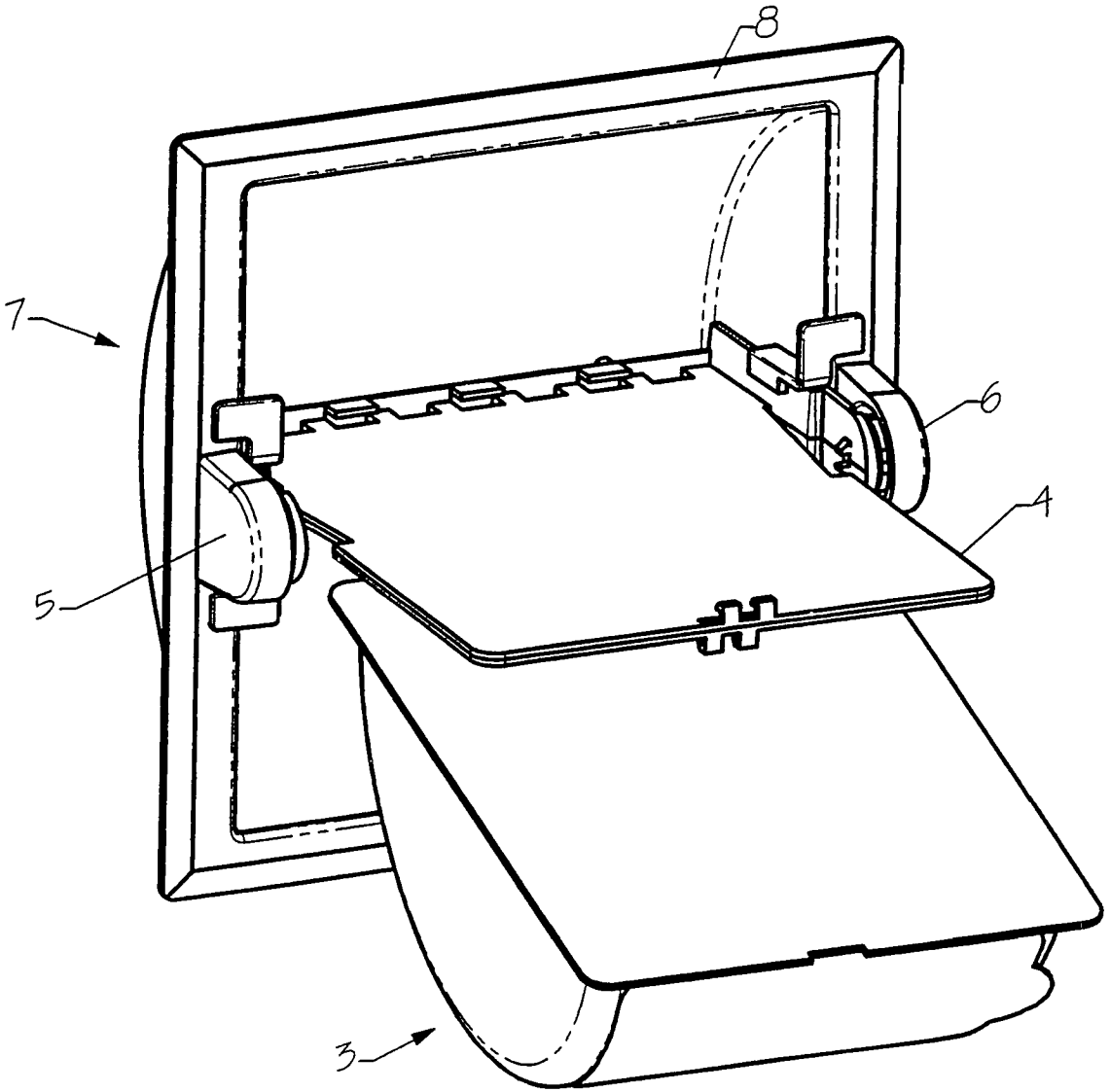
FIG. 18 shows the manner of installation of the dry paper canister.
Figure 19:
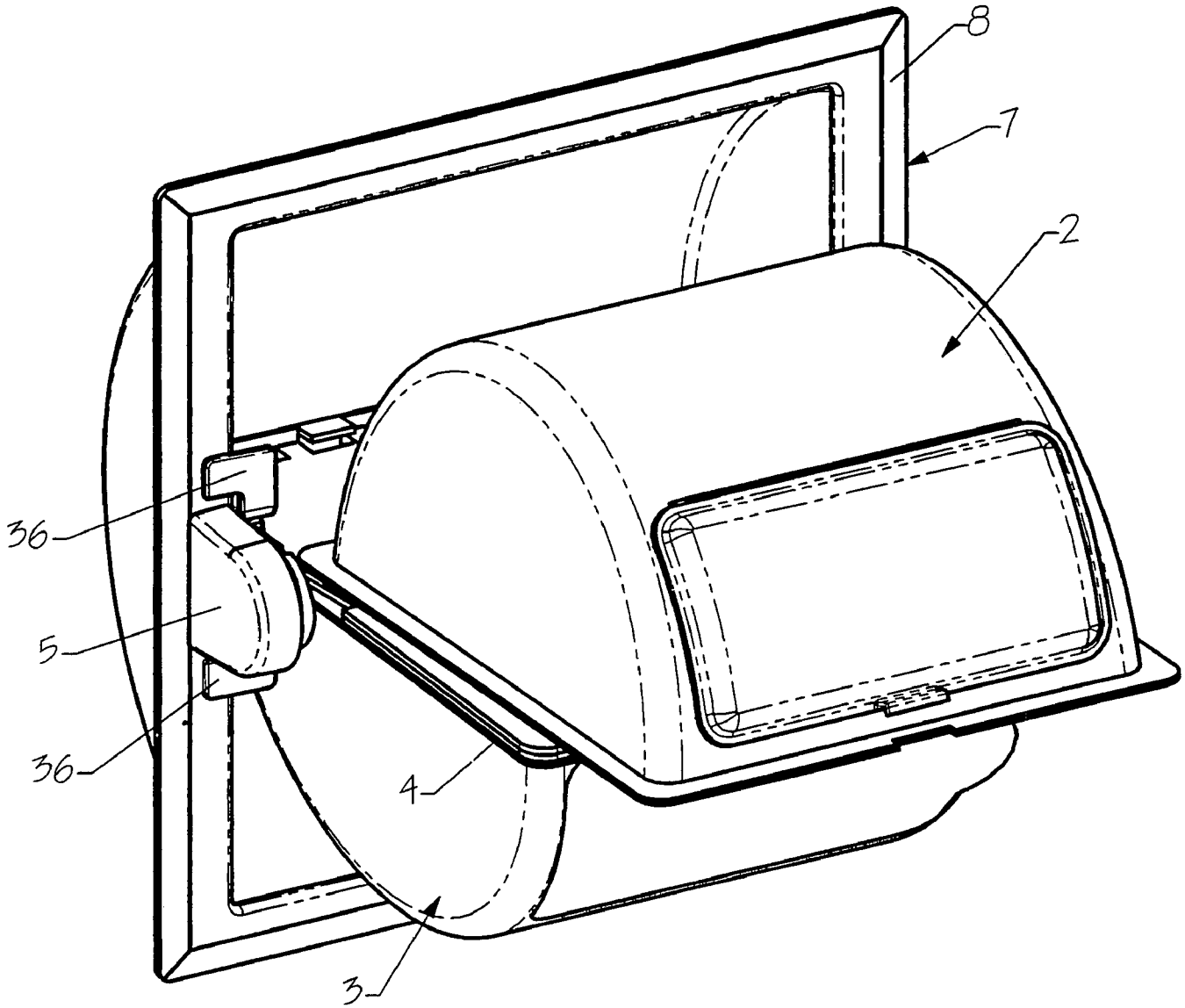
FIG. 19 shows the manner of installation of the wet paper canister.

In order to assemble the canister 3 on the shelf 4, reference is made to FIGS. 18 and 19 wherefrom it can be seen that the rear edge of the base and deck of the canister is engaged beneath the hooks 17 whereafter, and the slot 46 is latched to latch member 15.

Figure 16:
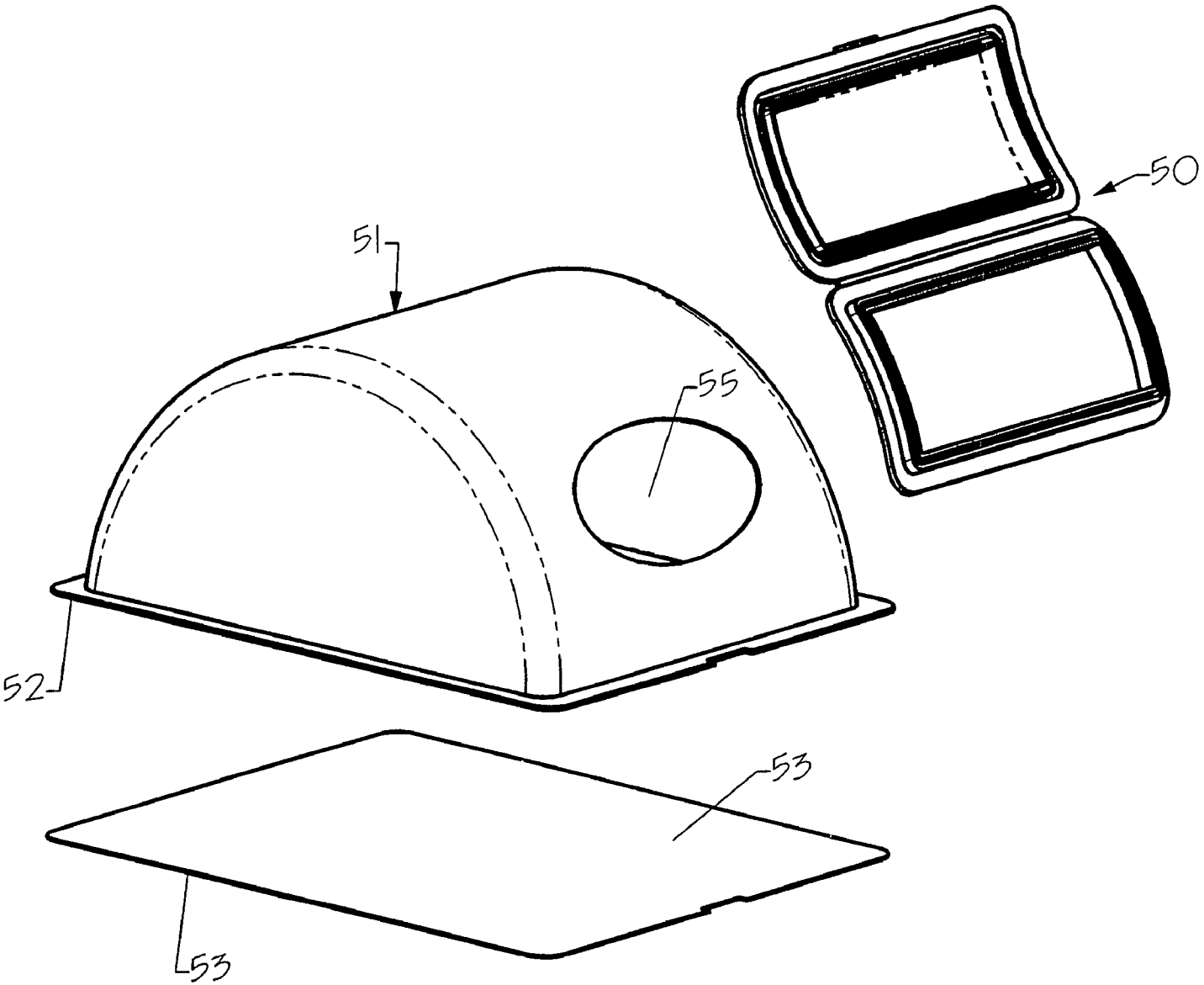
FIG. 16 is an exploded view of a wet paper canister.
Figure 17:
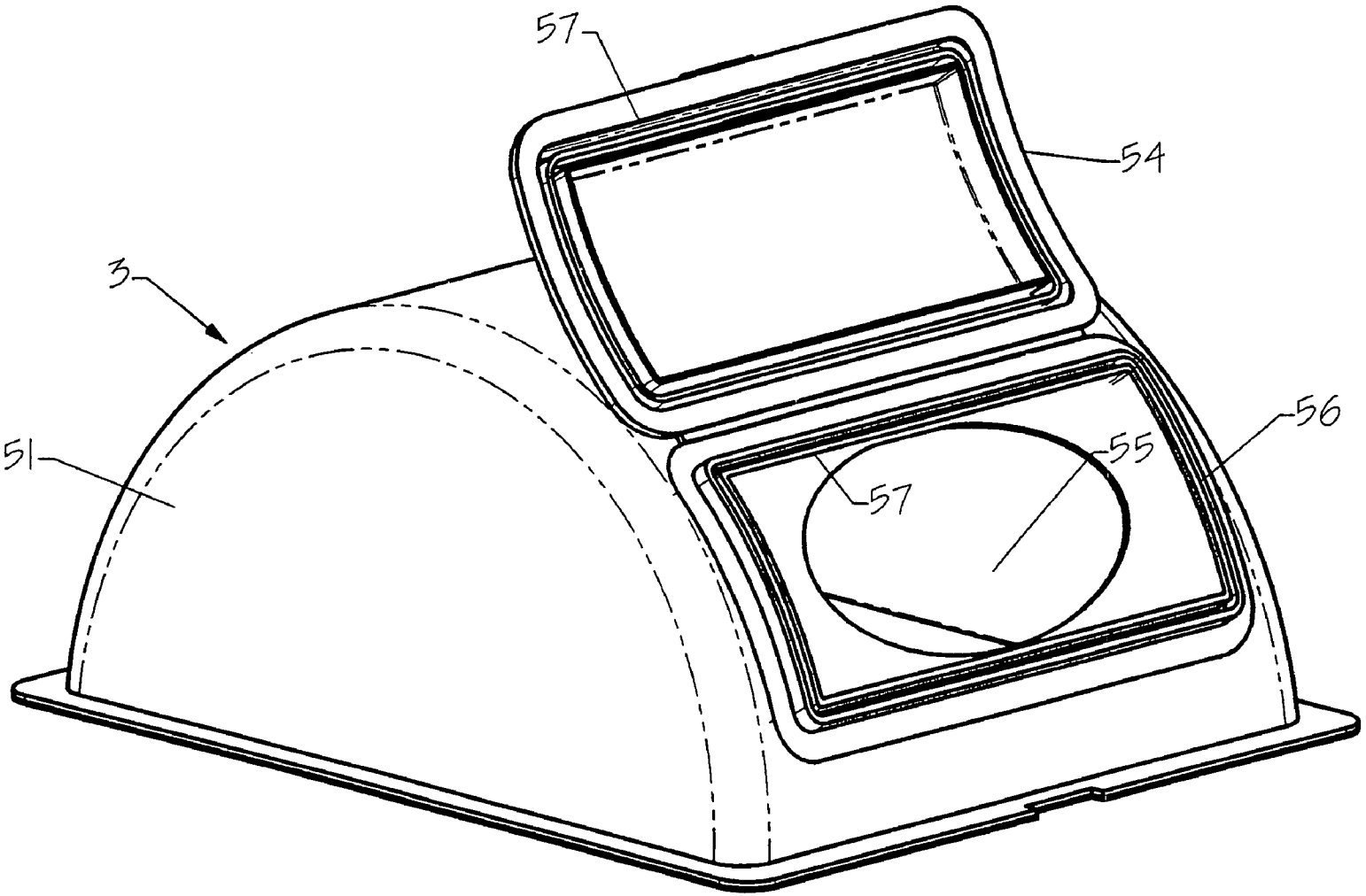
FIG. 17 shows the assembled wet paper canister.

FIGS. 16 and 17 show the construction of the canister 2 for wet paper and it is evident that this construction is similar to that of the dry paper canister. However, the wet paper canister must be hermetically enclosed to prevent evaporation of the liquid from the wet paper. To this end, a closable, sealable door assembly 50 is provided. As with the dry paper canister 3, the wet paper canister 2 has a semi-cylindrical cover 51, a base 52, and a deck 53, and the assembled wet paper canister 2 is shown in FIG. 17. In FIG. 17, a door 54 of door assembly 50 is shown in open position to expose dispensing opening 55 from which wet paper sheets can be removed. After removal of the desired number of wet paper sheets, the door 54 is closed. The door 54 and the frame 56 to which it is hingeably attached are provided with seals 57 extending all around the opening in the door and frame so that when the door is closed, the door assembly will be hermetically sealed. The opening 55 in the cover 51 is larger than opening 42 in the canister 3 to facilitate the removal of the wet paper from the canister.

After the dry paper canister 3 has been installed, the wet paper canister 2 is installed on the shelf 4, similar to that of canister 3 as shown in FIG. 19.

The order of installation of the canisters can be reversed.

Although the wet paper canister 3 has been shown mounted on top of the shelf, it is also possible to interchange the location of the canisters by inverting the shelf 4 and mounting the dry paper canister 3 on top of the shelf and the wet paper canister on the bottom of the shelf.

It is to be noted that the latch members 15, 16 are slightly offset from one another to engage respective slots 46 at the front edges of the canisters, which are correspondingly offset. In this way, the canisters can be inserted in only one configuration with respect to the shelf 4. Accordingly, once the shelf 4 is installed, the location of the canisters (top or bottom) is fixed. However, should it be desired to reverse the location of the canisters, it is only necessary to remove the shelf and invert it as previously stated.

As evident from the above, when a canister becomes empty, it is easily replaced with a full one by unlatching the front of the empty canister and sliding the canister forwardly to extract the rear edge from the hooks 17 at the rear edge of the shelf. The full canister is then installed by a reverse operation.

While the openings in the canisters for removing paper therefrom are shown at the front of the canisters, the openings can be located in other locations such as the top of the upper canister and the bottom of the lower canister.

Figure 20:
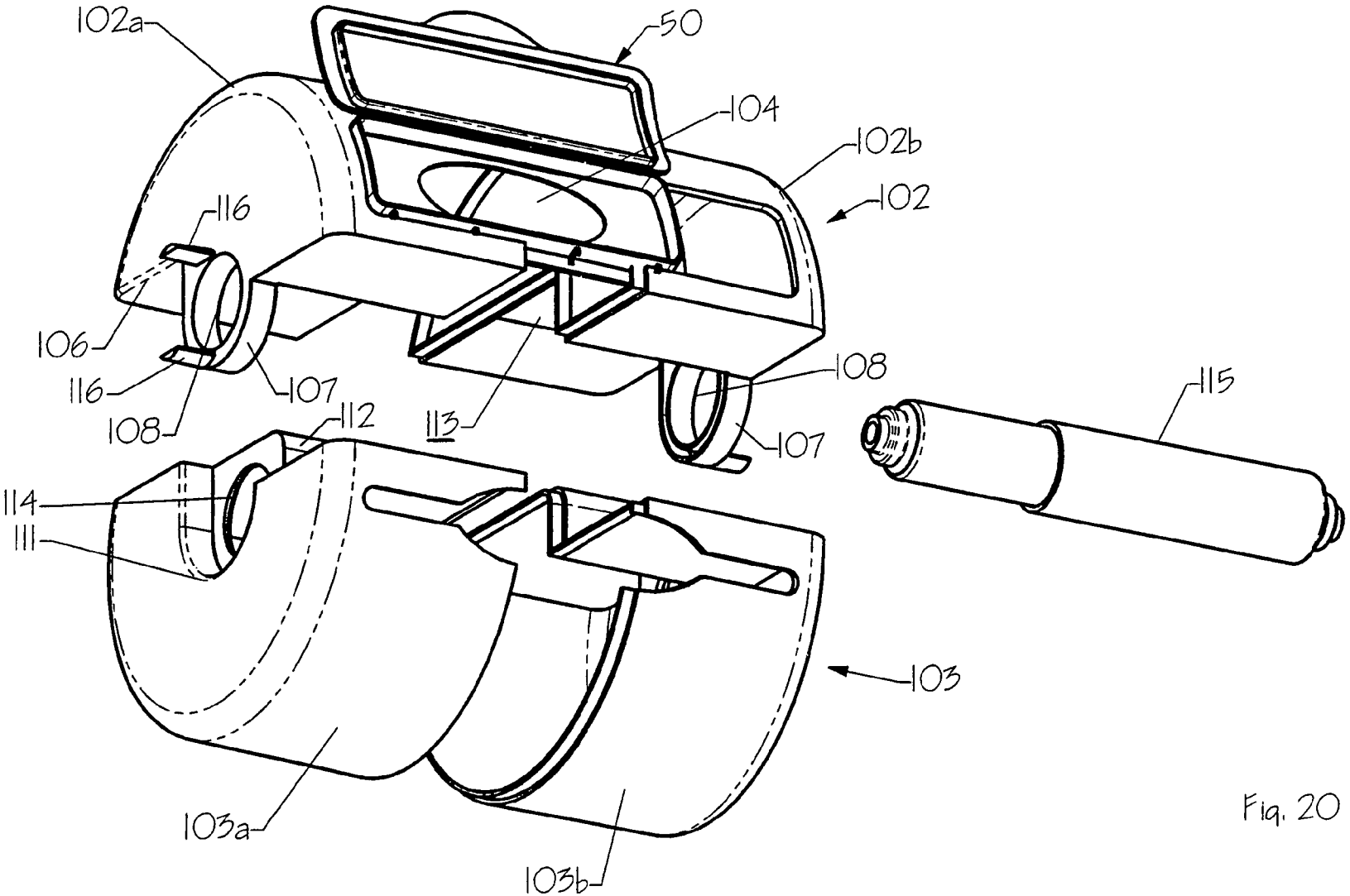
FIG. 20 is an exploded front perspective view from below of a wet paper and a dry paper canister of a second embodiment.
Figure 21:
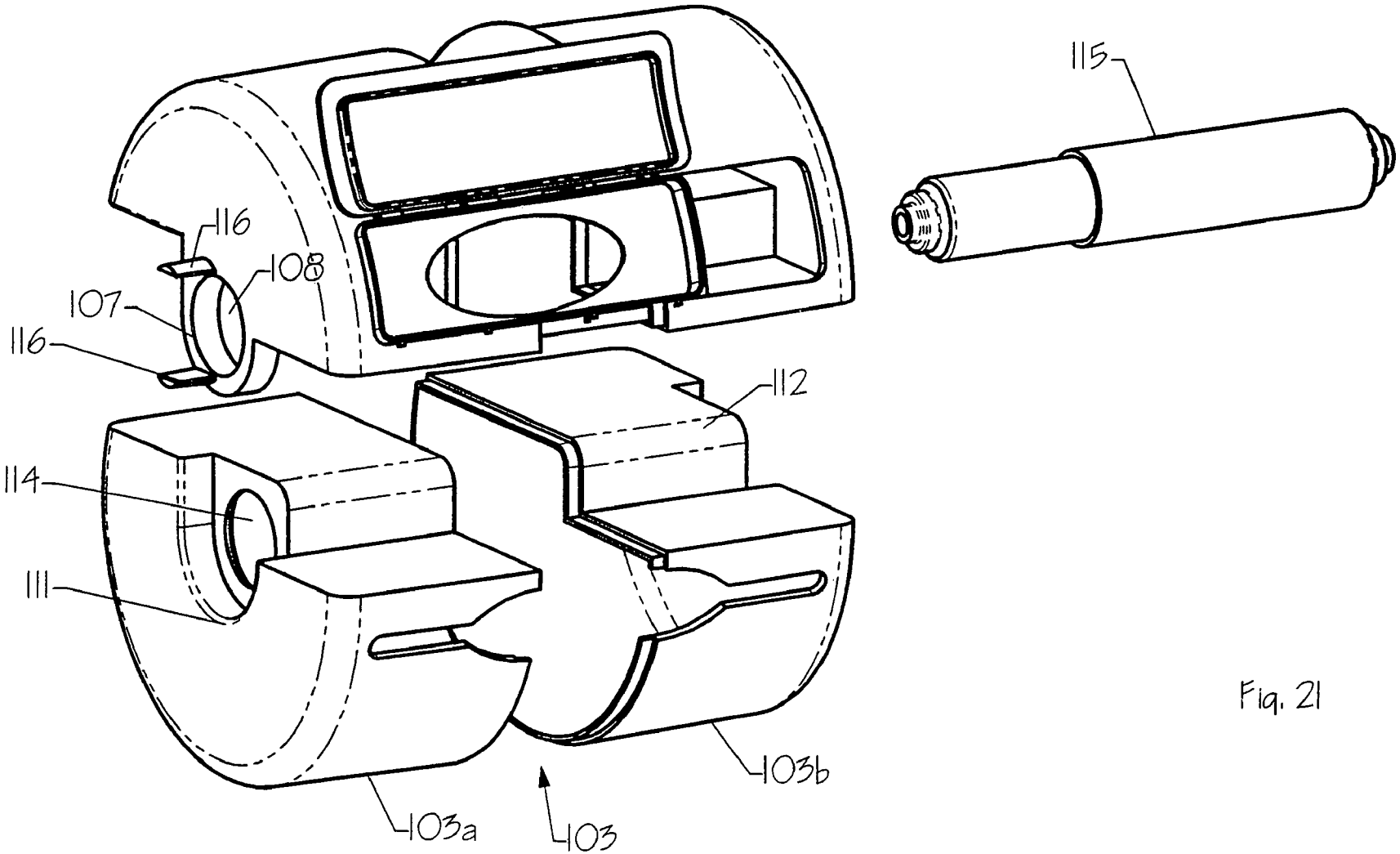
FIG. 21 is similar to FIG. 20 but viewed from above.
Figure 22:
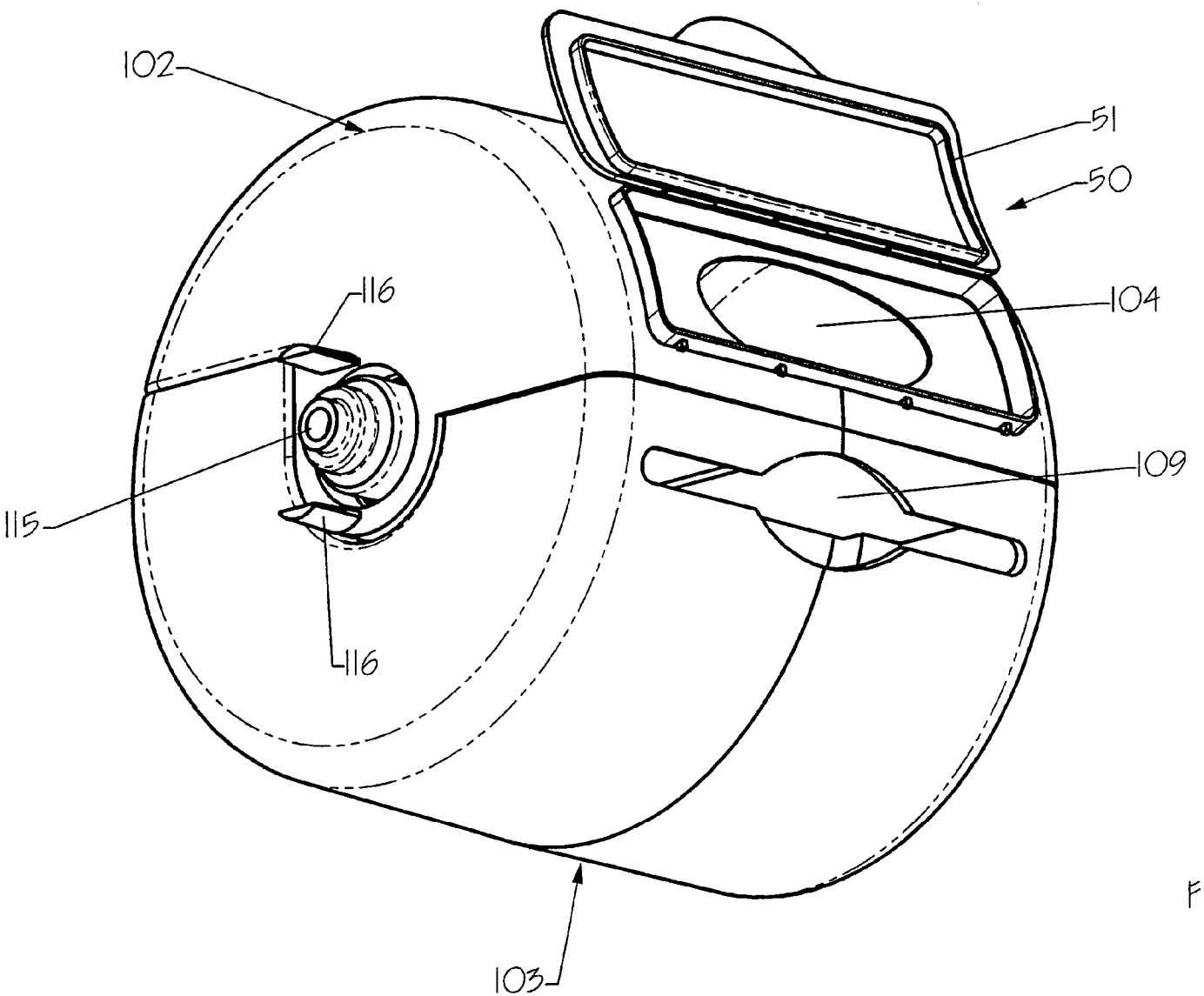
FIG. 22 shows the wet and dry paper canisters of the second embodiment assembled in readiness for installation in the holder.
Figure 23:
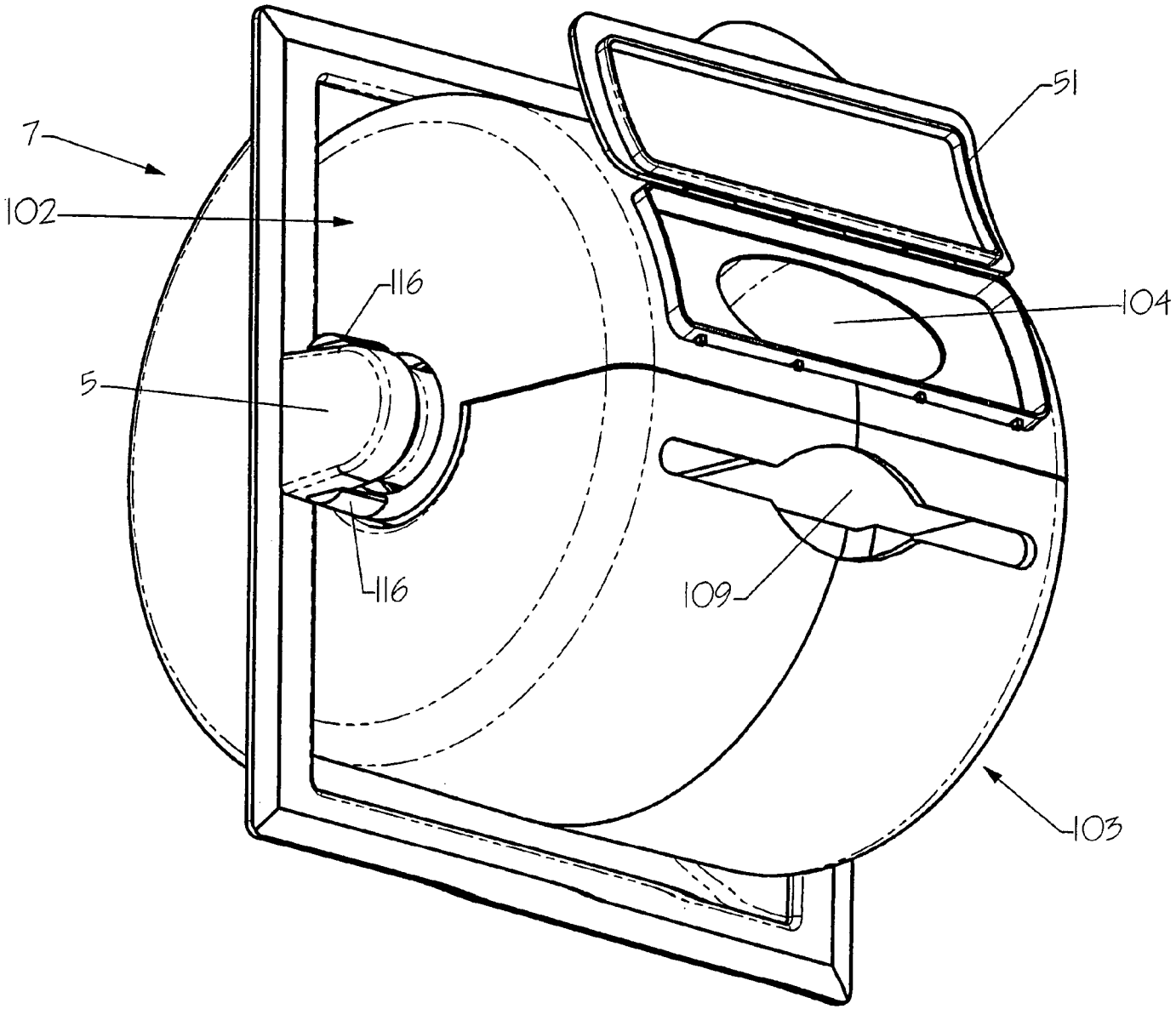
FIG. 23 shows the canisters of the second embodiment installed in the holder.

Reference is next be made to FIGS. 20-22 which show a second embodiment according to the invention.

The second embodiment is similar to the first embodiment in that it comprises canisters for wet and dry paper which when assembled form a cylindrical configuration similar to a conventional roll of toilet paper.

This embodiment departs from the first embodiment by eliminating the shelf thereof and by utilizing a rod or holder which is similar to or the same as a conventional holder for a roll of toilet paper.

The same reference numerals will be used to designate the same elements as in the first embodiment.

FIG. 20 shows canister 102 for wet paper and canister 103 for dry paper. The wet paper canister 102 is a closed body which contains the wet paper in an arrangement in which the wet paper can be extracted through opening 104 as in the previous embodiment either continuously or sheet by sheet depending on how the paper is packed in the canister. The canister 102 is made in two parts 102*a* and 102*b* which are slidably fitted together to form the completed canister 102. In this way, the wet paper canister can be refilled when it is empty. The completed canister 102 has a closed bottom wall 105 with a step 106. A pair of lugs 107 extend downwardly at the opposite sides of canister 102 and the lugs have holes 108 which are aligned with one another. Mounted at the opening 104 is the closable door assembly 50.

The canister 103 for dry paper is also a closed body and it contains dry paper in an arrangement in which the paper can be removed through the opening 109 (see FIG. 22) either sheet by sheet or continuously depending on how the paper is packed in the canister. The canister 103 is also made in two parts, 103*a* and 103*b* which are slidably fitted together to form the completed canister 103. In this way, the dry paper canister can be re-filled with paper when it is empty. The canister 103 for dry paper has U-shaped cut-outs at its sidewalls which conform to the lugs 107 on the wet paper canister to receive the lugs when the canisters are abutted against one another as shown in FIG. 22. The upper wall of the canister is formed with a raised block-like portion 112 which fits into a hollow 113 in the wet paper canister in correspondence with step 106. When the canisters are interfitted, the block-like portion 112 fits into hollow 113. The block-like portion 112 has a bore 114 extending therethrough which is aligned with the holes 108 in lugs 107 when the canisters are interfitted.

A telescopic rod or holder 115, similar or the same as a conventional holder for a roll of toilet paper, is engaged in the aligned holes 108, and bore 114 to hold the canisters 102 and 103 together.

The telescopic holder 115 is then installed in lugs 5 and 6 in the same manner as mounting the conventional toilet paper holder, namely by telescoping the ends of the holder inwardly until they engage in the blind bores in the lugs 5 and 6.

In order to secure the assembled canisters against rotation, the lugs 107 are provided with spaced outwardly projecting tabs 116 which engage lugs 5 and 6 at top and bottom and prevent rotation of the canister assembly relative to the lugs.

Figure 24:
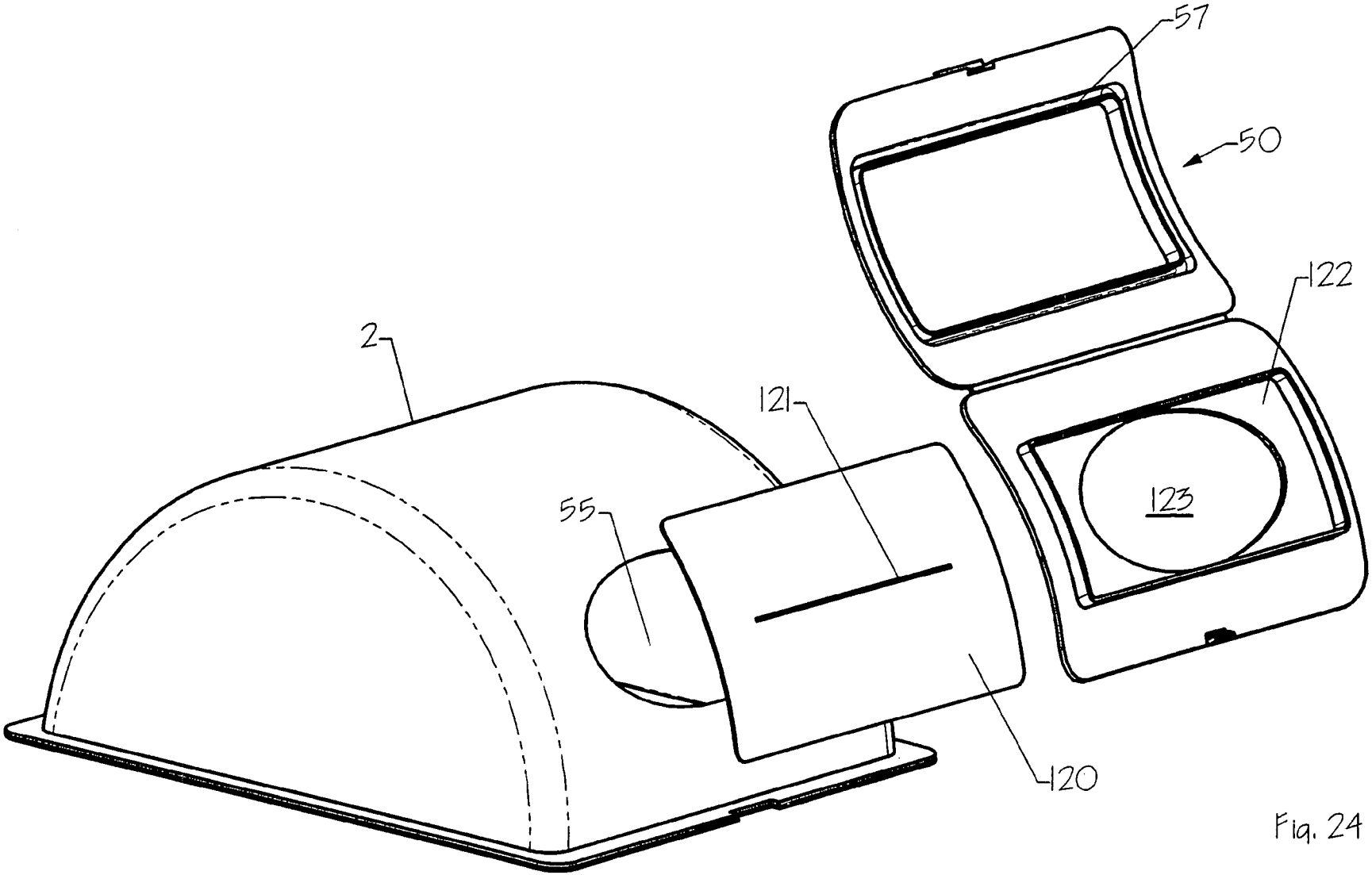
FIG. 24 is an exploded view of a modification of the wet paper canister illustrated in FIG. 17.
Figure 25:
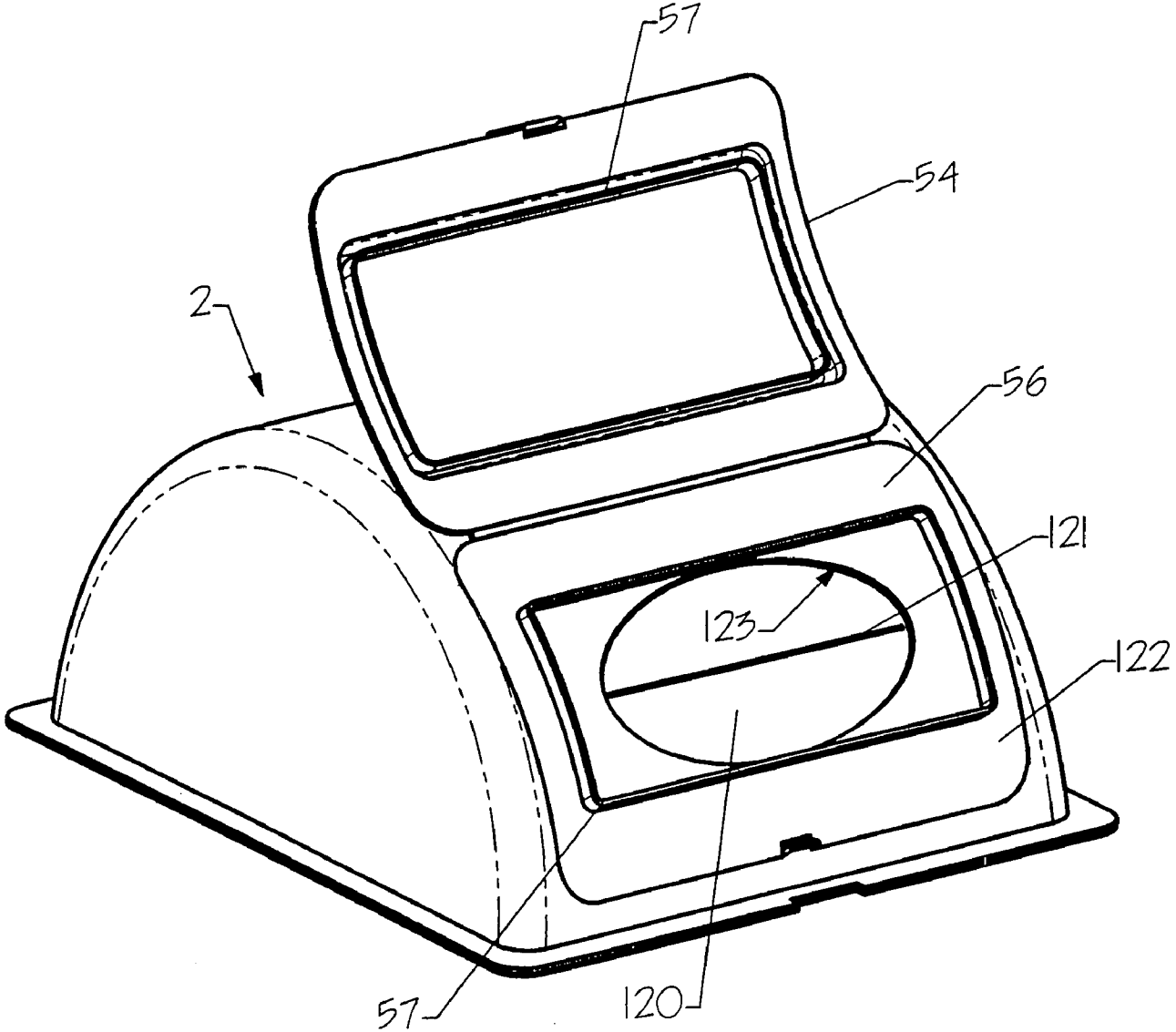
FIG. 25 shows the assembled canister in FIG. 24.
Figure 26:
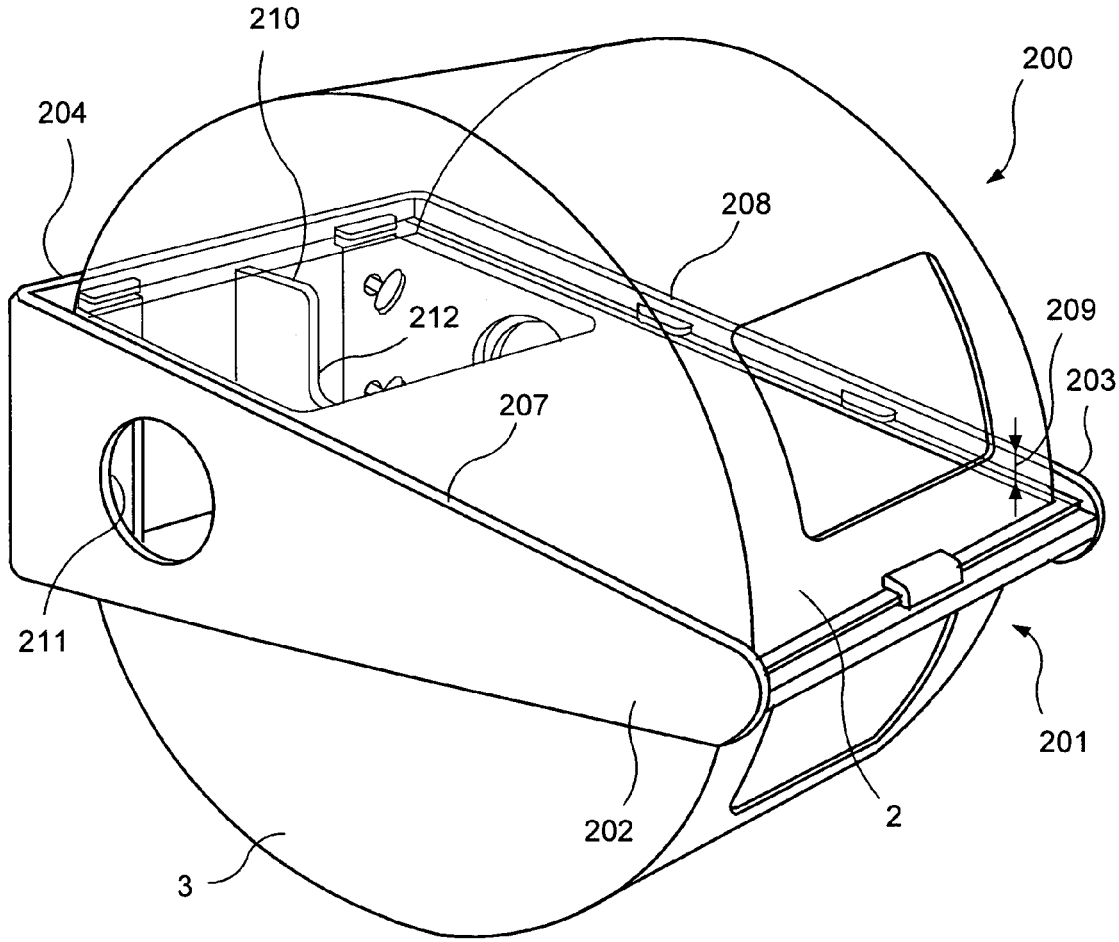
FIG. 26 is a top, right perspective view of a dispenser according to a third embodiment of the invention.
Figure 28:
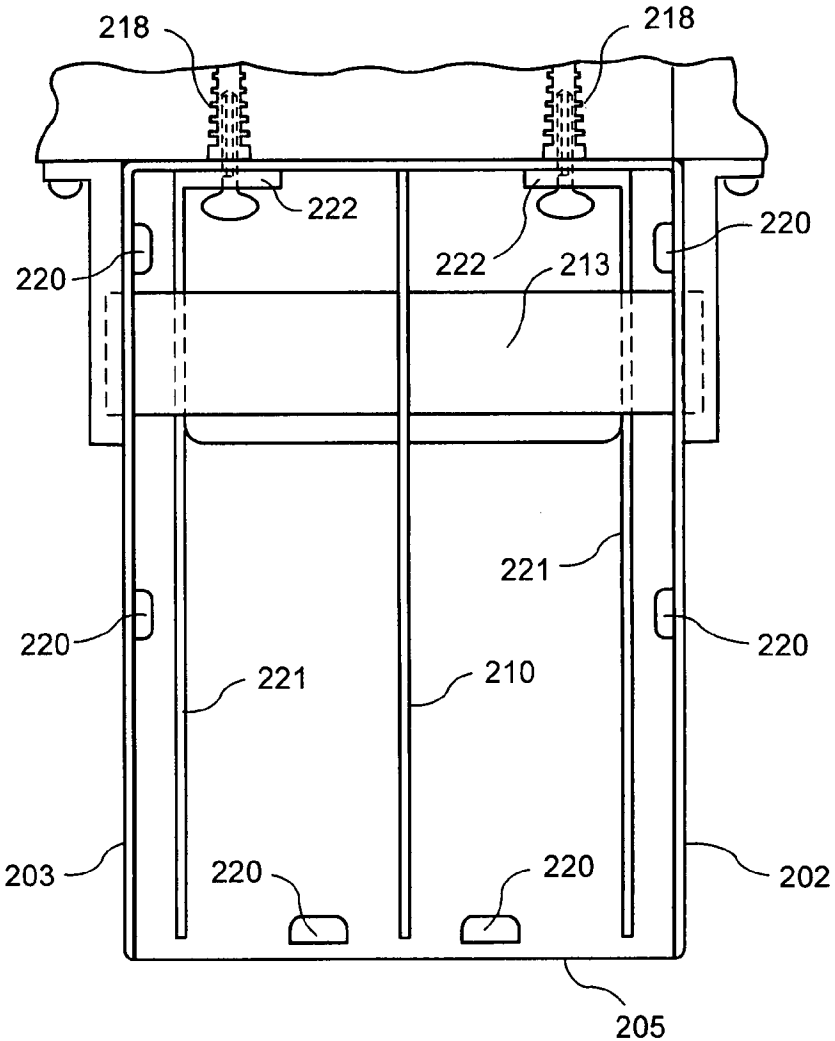
FIG. 28 is a bottom plan view of the dispenser of FIG. 26 in installed state.
Figure 27:
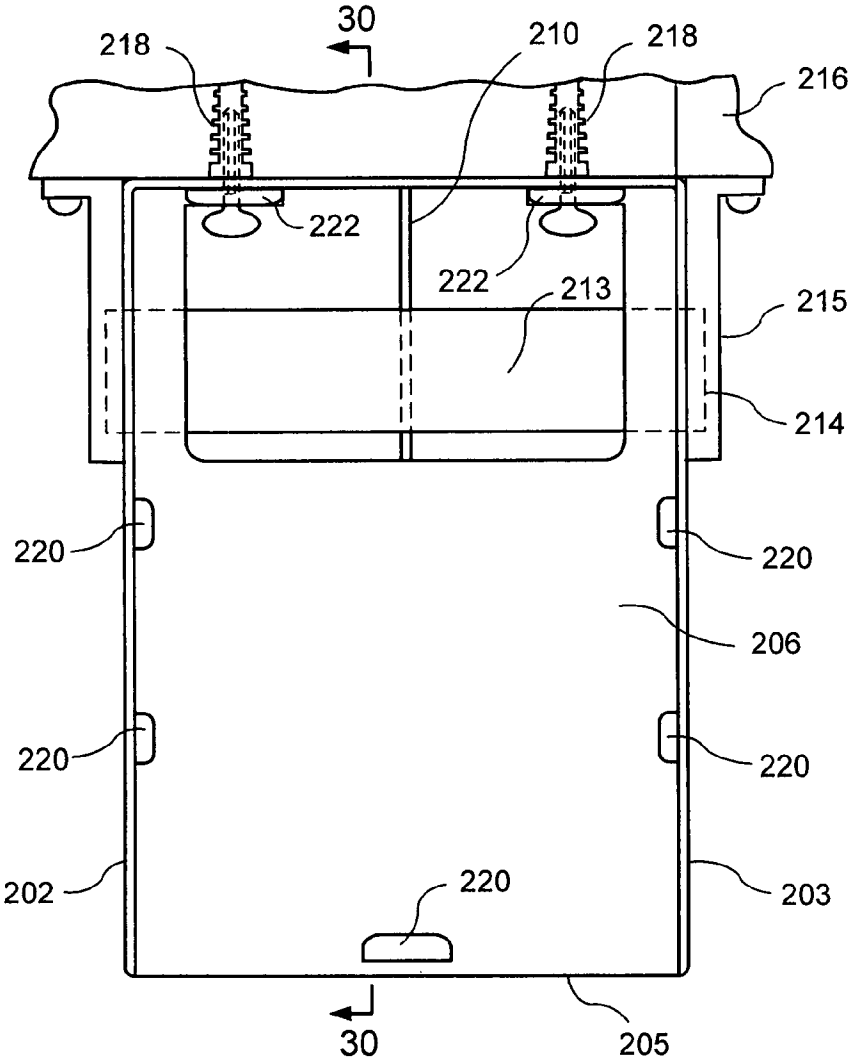
FIG. 27 is a top plan view of the dispenser of FIG. 26 in installed state.
Figure 29:
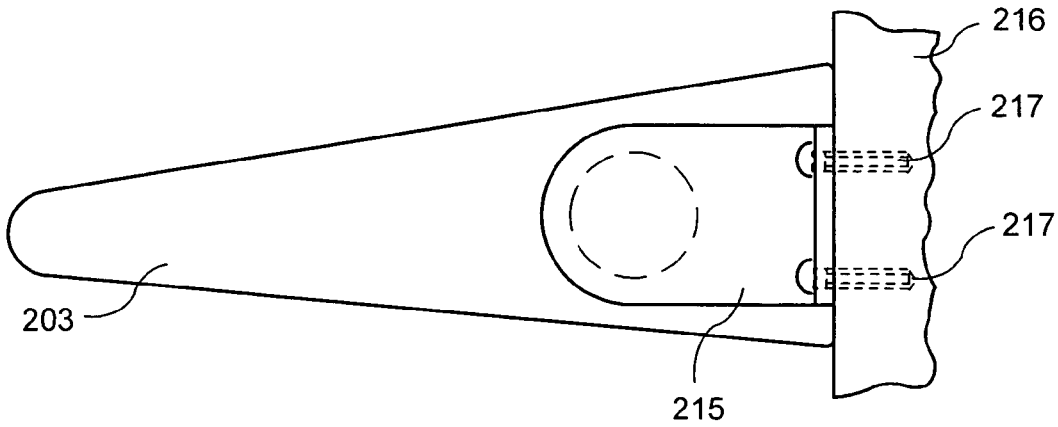
FIG. 29 is a side view of the dispenser in installed state, the view from the other side being a mirror image.
Figure 30:
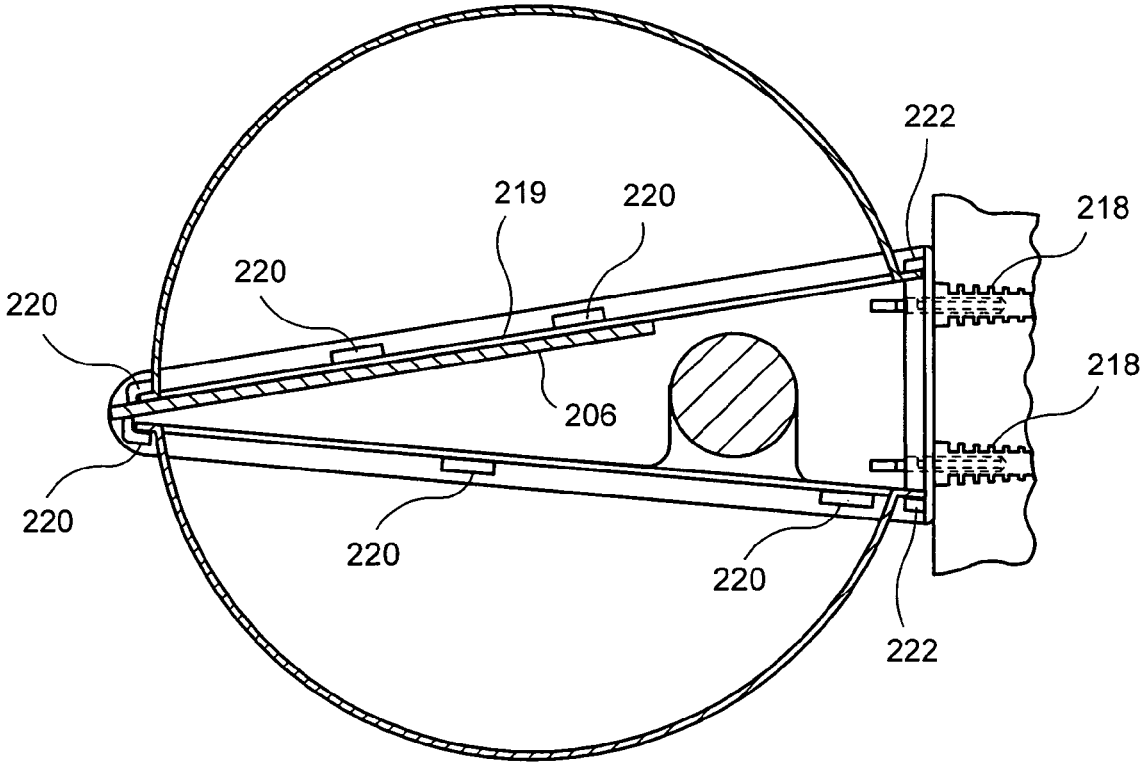
FIG. 30 is a sectional view taken on line 30-30 in FIG. 27.

FIGS. 24 and 25 show a modification of the wet paper canister 2 of FIG. 17 adapted to further prevent evaporation of liquid from the wet paper.

As shown in FIG. 24, an additional moisture barrier is formed over the opening 55 in canister 2. The moisture barrier is in the form of a thin soft, pliable plastic film 120 of a thickness of the order of 0.003" to 0.005". The film 120 has a slit 121 extending horizontally in the film to cover opening 55. The film 120 is secured by adhesive or other means to the cover of canister 2 and the frame 56 of the door assembly 50 whereby the film 120 is sandwiched between the frame 56 and the cover of canister 2 as seen in FIG. 25. The frame 56 is provided with an impermeable membrane 122 forming a shield with an opening 123 through which the slit 121 in film 120 is accessible. In this way, the wet paper is removed by the user from the canister 2 by inserting his or her hand through opening 123 in the frame and reaching through the slit 121 to grasp the next sheet of wet paper to be removed. Evaporation of moisture is prevented by film 120 in addition to seals 57.

FIGS. 26-30 show a third embodiment of the invention which is distinguished from the earlier disclosed embodiments in that the dispenser derives its main support from a back wall which can be a cabinet wall, the wall of the room or any other similar support wall. The dispenser is positioned using the toilet paper rod or holder as earlier described and can derive support from the rod but instead of being secured by the brackets of the rod, the main support for the housing is from the back wall.

Referring in particular to FIGS. 26-30 therein is seen a dispenser 200 having a housing 201 for supporting wet and dry canisters 2, 3 which have been previously described.

The housing 201 is a one piece body made of molded plastic material. The housing 201 has side members or walls 202, 203 extending parallel to one another and integrally joined to a back member 204. The side members 202, 203 taper in height from the back wall toward a front edge 205 of the housing. A shelf 206 is integrally formed with the side members and the back member and the shelf extends across the housing to separate the wet and dry canisters 2, 3 and thereby keep the paper in the respective canisters isolated from one another. The shelf 206 extends from the front edge 205 of the housing to the back member 204. The shelf 206 is inclined downwardly from the back member 204 to front edge 205 and is disposed slightly below the top edges 207, 208 of the side members 202, 203, to provide a uniform height 209 for the side members above the top surface of the shelf.

A reinforcing member 210 is integrally formed with the back member 204 and the shelf 206 and extends from edge 205 to the back member. The reinforcing member 210 extends midway between the side members 202 and 203.

The side members 202 and 203 have aligned holes 211 formed therein and the reinforcing member 210 has a U-shaped cut-out 212 which is aligned with the holes 211. The holes 211 and the cut-out 212 are dimensioned to receive a rod or toilet paper holder 213 as normally used to support a roll of toilet paper. The rod 213 is of conventional spring-loaded telescopic construction.

The housing 201 receives the rod 213 in the holes 211 and the cut out 212 and the ends of the rod are fitted into bores or openings 214 in brackets 215. The brackets 215 are secured to a support 216 which can be the wall of a cabinet, the wall of a room or other suitable support. The brackets are secured to the support or wall 216 by fasteners 217.

The housing 201 is fixedly secured to the wall 216 by fastener members 218. Although the fastener members 218 have been illustrated as bolts, any suitable attachment system to the wall 216 can be utilized, such as adhesives Velcro or the like. If necessary, suitable spacers (not shown) can be used in securing the housing to the wall.

With reference to FIG. 14 showing the construction of a typical canister, the base 41 and deck 43 form a projecting rim 219 which is detachably held by the housing. In this regard, tabs 220 are provided on the side members 202, 203 near the upper and lower edges thereof and the tabs 220 at the upper edges of the side members hold the rim 219 of the canister 2 between the tabs 220 and the upper surface of the shelf 206. At the lower edges of the side members 202, 203 the tabs 220 hold the rim 219 of the canister 3 against the edges of flanges 221 integrally formed in the housing and extending from the lower edge 205 to the back member 204. These flanges also provide additional rigidity for the housing.

At the upper and lower edges of the back member 204 studs 222 are integrally formed and provided with slits 223 which received the back of rims 219 of the canisters 2, 3 to secure the canisters in position. Tabs 220 are also formed at edge 205 above and below the shelf 206 in order to securely hold the front of rims 219 of the canisters. The canisters have sufficient flexibility so that the rims 219 thereof can be readily inserted and removed from the housing.

The shelf 206 is provided with a large opening 224 adjacent to the back member 204 to provide access to the rod 213 for installation and removal thereof in the housing.

Although numerous modifications and variations of the disclosed embodiments will become evident to those skilled in the art, these will fall within the scope and spirit of the invention if they are defined within the appended claims. Thus, for example, although the housing has been described as being cylindrical, it can be slightly out-of-round or of other shape within the scope of the invention.

What is claimed is:

1. A dispenser for wet and dry paper comprising:

a housing;

a first canister for wet paper;

a second canister for dry paper;

said first and second canisters being separate and provided with their respective papers in isolation from one another for being removed in use from the respective canister through a dispensing opening therein;

said canisters being connected to said housing so that the wet and dry papers can be removed from the respective canisters;

means for supporting said housing from brackets of a toilet paper holder; and means for securing said housing to a wall.

2. The dispenser according to claim 1, wherein said means for securing the housing to a wall comprises an attachment system for attaching the housing to the wall.

3. The dispenser according to claim 2, wherein the attachment system comprises fastener members.

4. The dispenser according to claim 2, wherein said housing includes a shelf, said first and second canisters being mounted on said housing on opposite sides of said shelf.

5. The dispenser according to claim 4, wherein said housing further includes a pair of spaced side members and a back member connected to said side members, said shelf being secured to said back member and said side members, said shelf, said side members and said back member forming an integral one-piece body.

6. The dispenser according to claim 5, wherein said one-piece body is made of molded plastic material.

7. The dispenser according to claim 5, wherein said shelf is inclined downwardly from said back member to a front edge of said housing.

8. The dispenser according to claim 5, wherein said one-piece body is made of molded plastic material.

9. The dispenser according to claim 5, wherein said side members are provided with aligned openings through which a rod can be slidably inserted and engaged with the brackets of the toilet paper holder to support the housing, said attachment system connecting said back member to the wall.

10. The dispenser according to claim 9, wherein said shelf is provided with an opening through which said rod is accessible.

11. The dispenser according to claim 9, wherein said reinforcing member has a cut-out through which said rod can extend.

12. The dispenser according to claim 9, wherein said housing includes means for detachable and interchangeable connection of said first and second canisters with the housing.

13. The dispenser according to claim 12, wherein said first and second canisters each has a bottom of rectangular form with a protruding rim thereat, said rim being detachably held by said housing.

14. The dispenser according to claim 13, wherein said side members have tabs and said back member and said shelf have slots, said rims of the first and second canisters being able to be detachably held by said tabs and said slots.

15. The dispenser according to claim 14, wherein said side members widen in height from a front of the housing to said back member.

16. A dispenser for wet and dry paper comprising:

a housing including a shelf;

a first canister for wet paper;

a second canister for dry paper;

said first and second canisters being separate and provided with their respective papers in isolation from one another for being removed in use from the respective canister through a dispensing opening therein;

said canisters being connected to said housing on opposite sides of the shelf so that the wet and dry papers can be removed from the respective canisters; and means for securing said housing to a wall.

17. The dispenser according to claim 16, wherein said first and second canisters are detachably connected to said housing.

18. The dispenser according to claim 16, wherein said means for securing the housing to a wall comprises an attachment system for attaching the housing to the wall.

19. The dispenser according to claim 16, wherein said housing further includes a pair of spaced side members and a back member connected to said side members, said shelf being secured to said back member and said side members, said shelf, said side members and said back member forming an integral one-piece body.

20. The dispenser according to claim 19, wherein said one-piece body is made of molded plastic material.

21. The dispenser according to claim 19, wherein said side members are provided with aligned openings through which a rod can be slidably inserted and engaged with brackets of a toilet paper holder to support the housing, said attachment system connecting said back member to the wall.

22. The dispenser according to claim 19, wherein said side members widen in height from a front of the housing to said back member.

23. The dispenser according to claim 16, wherein said housing includes means for detachable and interchangeable connection of said first and second canisters with the housing.

24. The dispenser according to claim 23, wherein said first and second canisters each has a bottom of rectangular form with a protruding rim thereat, said rim being detachably held by said housing.

25. A method for separate dispensing of wet paper and dry paper from a common dispenser comprising:

providing a first canister containing wet paper, the first canister having an opening from which the wet paper can be removed;

providing a second canister containing dry paper, the second canister having an opening from which the dry paper can be removed;

supporting a housing by a rod engaged in holes in brackets normally used for supporting a roll of toilet paper;

securing said housing to a wall to fix the housing in place between said brackets; and connecting the first and second canisters to said housing with the openings thereof facing forwardly to enable separate dispensing of the wet and dry papers.

26. The method according to claim 25 comprising detachably mounting the first and second canisters on the housing, respectively at a top and bottom of the housing.

27. The method of claim 25, wherein the assembled canisters are of part cylindrical shape so that when the canisters are mounted on the housing they form a generally cylindrical outline simulating an outline of a conventional roll of toilet paper.

28. A method for separate dispensing of wet paper and dry paper from a common dispenser comprising:

providing a first canister containing wet paper, the first canister having an opening from which the wet paper can be removed;

providing a second canister containing dry paper, the second canister having an opening from which the dry paper can be removed;

securing a housing to a wall; and connecting the first and second canisters in juxtaposition to said housing with the openings thereof facing forwardly to enable separate dispensing of the wet and dry papers.

29. The method according to claim 28, comprising detachably mounting the first and second canisters on the housing, respectively at a top and bottom of the housing.

30. The method of claim 29, wherein the canisters are of part cylindrical shape so that when the canisters are mounted on the housing they form a generally cylindrical outline simulating an outline of a conventional roll of toilet paper.

* * * * *